US009611722B2

(12) United States Patent
Hern et al.

(10) Patent No.: US 9,611,722 B2
(45) Date of Patent: Apr. 4, 2017

(54) TOP DOWN LINER CEMENTING, ROTATION AND RELEASE METHOD

(71) Applicant: Baker Hughes Incorporated, Houston, TX (US)

(72) Inventors: Christopher R. Hern, Porter, TX (US); Matthew J. Kruger, Houston, TX (US); Daniel C. Ewing, Katy, TX (US); Travis J. Ansohn, Cypress, TX (US); Jason P. Lacombe, Katy, TX (US); Jarandon J. Adams, Spring, TX (US); Michael Ramon, Houston, TX (US); Steve M. Cortez, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 530 days.

(21) Appl. No.: 14/134,000

(22) Filed: Dec. 19, 2013

(65) Prior Publication Data

US 2015/0176367 A1 Jun. 25, 2015

(51) Int. Cl.
*E21B 33/138* (2006.01)
*E21B 34/14* (2006.01)
*E21B 33/14* (2006.01)

(52) U.S. Cl.
CPC ..... *E21B 34/14* (2013.01); *E21B 33/14* (2013.01)

(58) Field of Classification Search
USPC ..... 166/285
See application file for complete search history.

(56) References Cited

U.S. PATENT DOCUMENTS

| | | | | |
|---|---|---|---|---|
| 8,387,693 | B2 | 3/2013 | Tunget | |
| 2008/0110620 | A1* | 5/2008 | Penno | E21B 43/045 166/278 |
| 2010/0155067 | A1 | 6/2010 | Tunget | |
| 2012/0292046 | A1* | 11/2012 | Klimack | E21B 33/068 166/378 |

* cited by examiner

*Primary Examiner* — Taras P Bemko
(74) *Attorney, Agent, or Firm* — Steve Rosenblatt

(57) ABSTRACT

A top down cementing tool operates with either mechanical manipulation or hydraulically. Rotation of the liner during cementing is enabled. A first bore is open for circulation during running in of the liner. In the hydraulic version, pressuring up on a dropped ball in the first bore opens cement packer setting ports and aligns crossover ports from the first bore to the annulus below the cementing packer and displaced fluid return ports to the annulus above the cementing packer. Pressuring up on a trailing wiper plug in the first bore opens the second bore so that pressuring on a seated ball in the second bore opens access to unsetting the cementing packer and launching the ball in the second bore for liner hanger setting and release of the running tool. The alternative embodiment gets the same result but with string manipulation for some of the realignments.

31 Claims, 33 Drawing Sheets

TOP DOWN LINER CEMENTING, ROTATION AND RELEASE METHOD

FIELD OF THE INVENTION

The field of the invention is top down cementing and more particularly with fluid displacement by the cement through a crossover with the ability to rotate the liner while cementing and further provisions for setting a liner hanger and release of a running tool from the cemented liner.

BACKGROUND OF THE INVENTION

Traditional liner cementing involves delivery of cement through a liner that is hung off casing with the cement going through a cement shoe at the lower end of the liner and back around in the annular space around the suspended liner. Fluid is displaced by the advancing cement through the liner hanger. At the time of fluid displacement with cement, the seal on the liner hanger is not set and there are gaps between the anchor slips through which the displaced fluid moves. After the cement is delivered a trailing wiper plug is released to clear the liner of excess cement. The cement shoe has a check valve to prevent return of the cement. The seal on the liner hanger is then set and the liner running tool is released and pulled out of the hole. The shoe can be milled or drilled out and more hole can then be drilled and the process can be repeated.

In some situations there can be doubt that the cement is adequately distributed using this method and an alternative technique for cement placement is desired. This is particularly beneficial when a formation is particularly weak which can result in significant fluid loses due to low fracking gradients. In a top down delivery of cement the operating pressures to which the formation is exposed are far less than the traditional bottom up cementing which can be beneficial in minimizing impact on the formation and ultimately getting a higher production rate from the formation when the well is put into production.

While there has been talk in the industry of doing top down cementing as a concept there have been no disclosed tools that would successfully and reliably accomplish such a cementing method. At best, schematic drawings for the flow of cement and return flows are illustrated in discrete passages with no clear details of how such tools get reconfigured for the various positions needed to actually accomplish top down cementing. Some examples of this are U.S. Pat. No. 8,387,693 FIG. 117 and the associated discussion in one paragraph in the specification and US 2010/0155067 that mentions ports such as 44 and seal bores in a passing reference to top down cementing with little detail as to how the tool is reconfigured for running in and then cementing and no details how to accomplish any associated tasks such as rotation while cementing, setting a liner hanger and releasing a running tool or how to structure a crossover tool and reconfigure such a tool between cement placement and the need to set a liner hanger/packer after cementing.

A top down cementing tool operates with either mechanical manipulation or hydraulically with rotation of the liner during cementing enabled. A first bore is open for circulation during running in of the liner. In the hydraulic version, pressuring up on a dropped ball in the first bore opens cement packer setting ports and aligns crossover ports from the first bore to the annulus below the cementing packer and displaced fluid return ports to the annulus above the cementing packer. Pressuring up on a trailing wiper plug in the first bore opens the second bore so that pressuring on a seated ball in the second bore opens access to unsetting the cementing packer and launching the ball in the second bore for liner hanger setting and release of the running tool. The alternative embodiment gets the same result but with string manipulation for some of the realignments.

Embodiments are presented that operate hydraulically and mechanically to get the same result. In either case, rotation of the liner during cementing is enabled. Those skilled in the art will better understand additional aspects of the present invention from a review of the detailed description of the preferred embodiments and the associated drawings while recognizing that the full scope of the invention can be found in the appended claims.

SUMMARY OF THE INVENTION

The present invention presents alternative embodiments to make top down cementing a reality. The basic interpretation of the invention switches from the conventional flow pattern to a crossed over flow pattern and then back to a conventional flow pattern. The invention uses a dual bore mandrel to allow internal flow in both the upward and downward directions during cementing. During run-in of the tool the invention has flow isolated to the Inlet bore. Both bores of the dual bore mandrel have ports. The inlet bore has ports below the packer element and the return bore has ports above the packer element. The ports on both bores are blocked from allowing flow to pass through them during the run in position. A ball will be dropped to set a cementing packer that will isolate the crossover ports for inserting the cement from those used to allow bypass for the return fluid. Manipulation of the tool through hydraulic or mechanical actuation opens the bypass ports allowing the transition from conventional flow to cross over flow. Flow rates are established at this time and then the cementing operations are performed. During cementing the tool can be rotated through the packer so a more even application of the cement occurs. At the end of the cementing operations the inlet bore is closed off by a sealing object dropped from surface and pressure can be increased to open the upper end of the return bore allowing the return a conventional flow path. Hydraulic or mechanical actuation is then performed to isolate the return ports so flow is blocked through them. Additional hydraulic or mechanical manipulation will unset the packer element allowing external bypass. Further hydraulic or mechanical actuation can then be performed to send a preloaded object from within the tool to set the liner string below and release the running tools allowing detachment and retrieval of the proposed tool. Standard cleaning operations for removing excess cement from the top of the liner can be done through the return fluid bore because the flow has been returned to conventional flow path.

DETAILED DESCRIPTION OF THE PREFERRED EMBODIMENT

Figure 1A:
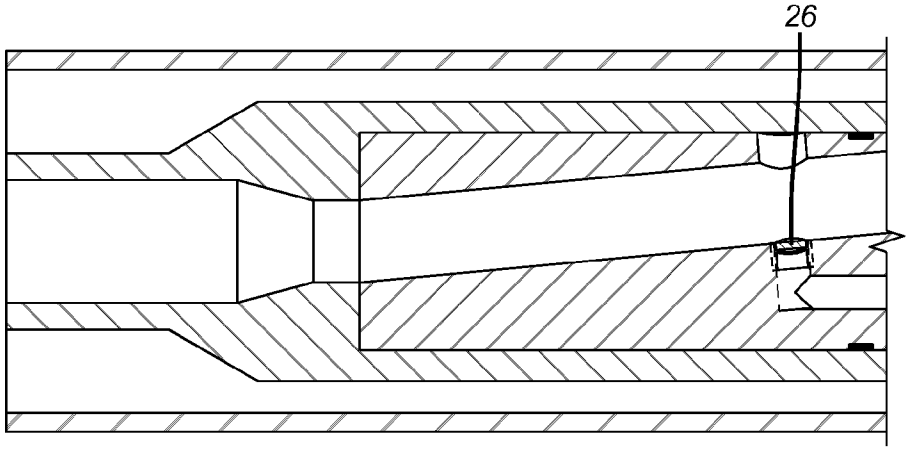
FIGS. 1*a*-1*e* are the hydraulic embodiment of the tool in the run in position.
Figure 1B:
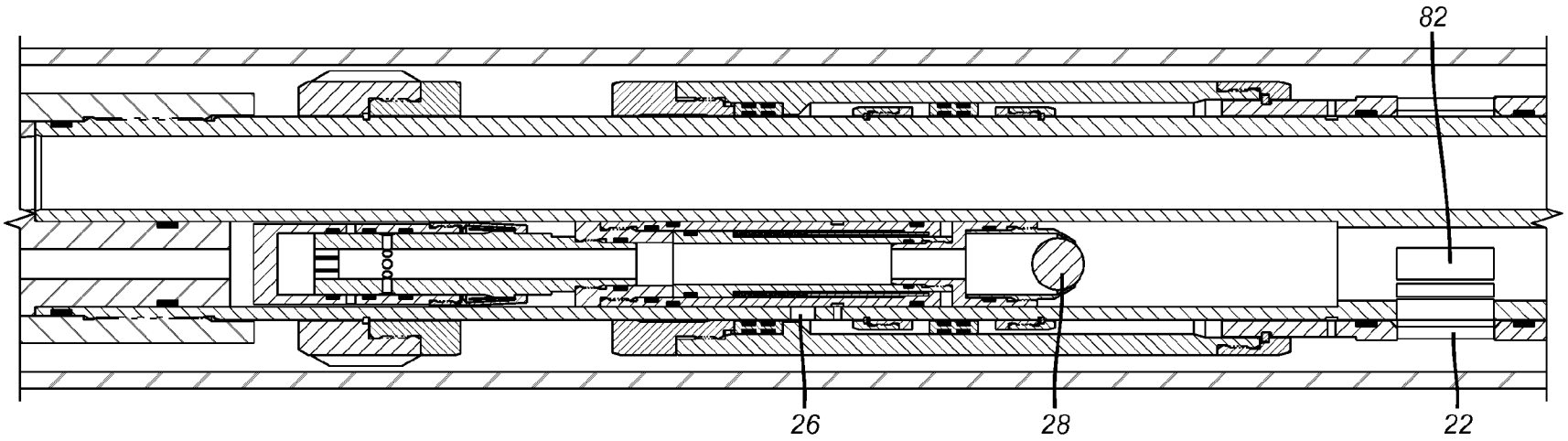
Figure 1C:
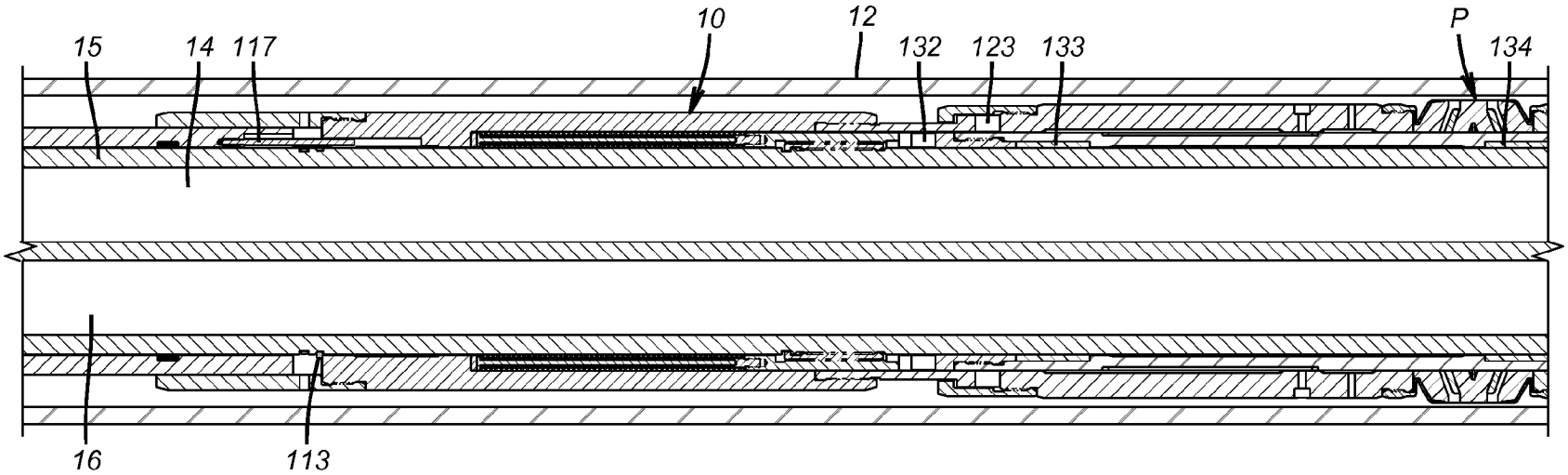
Figure 1D:
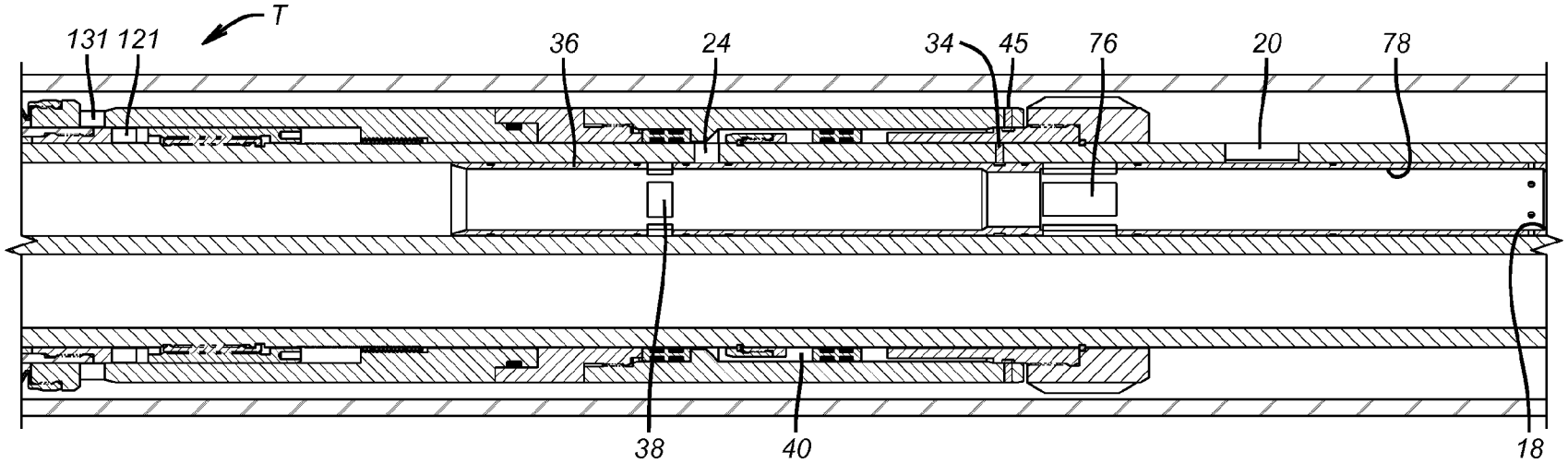
Figure 1E:
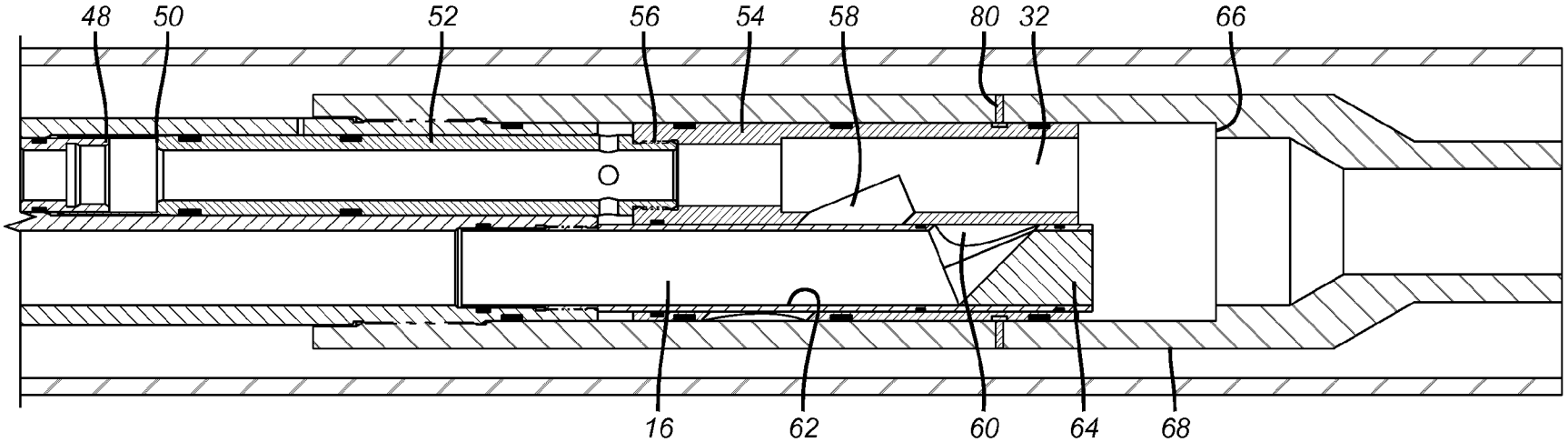

FIGS. 1*a*-1*e* show the fully hydraulic embodiment of the present invention in the run in position. The top down cementing tool T sits inside the previous casing 12. The liner and associated hanger/packer are below and are not shown. The liner hanger/packer are a known design and operate in a known manner including the setting and the release from the top down cementing tool T.

The major components of the tool T are a cementing packer P, an inlet bore 14, a return bore 16, an isolation sleeve 36, a cement crossover port 20, a returns crossover port 22, a packer actuation port 24, a packer release port 26 and a liner hanger/packer actuation ball 28. For running in the isolation sleeve 36 has no ball 30 so that circulation is possible down inlet bore 14 to its lower end 32 where the flow can then enter the liner and come back to the surface in the annular space outside the liner.

Figure 2A:
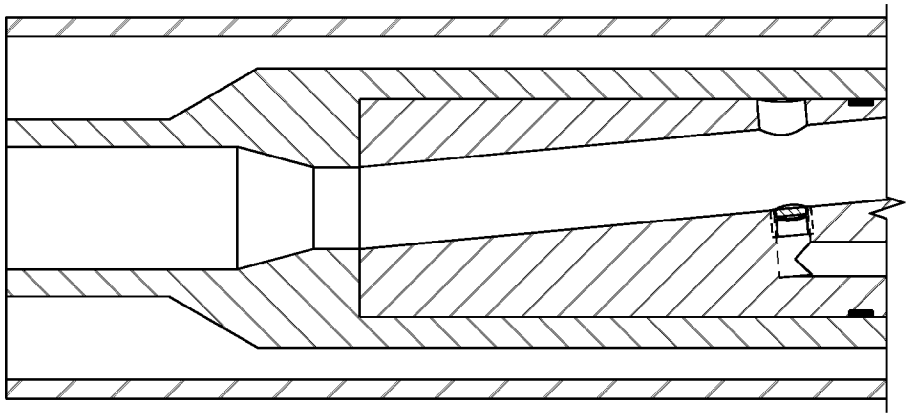
FIGS. 2*a*-2*e* are the view of FIGS. 1*a*-1*e* in the packer setting position.
Figure 2B:
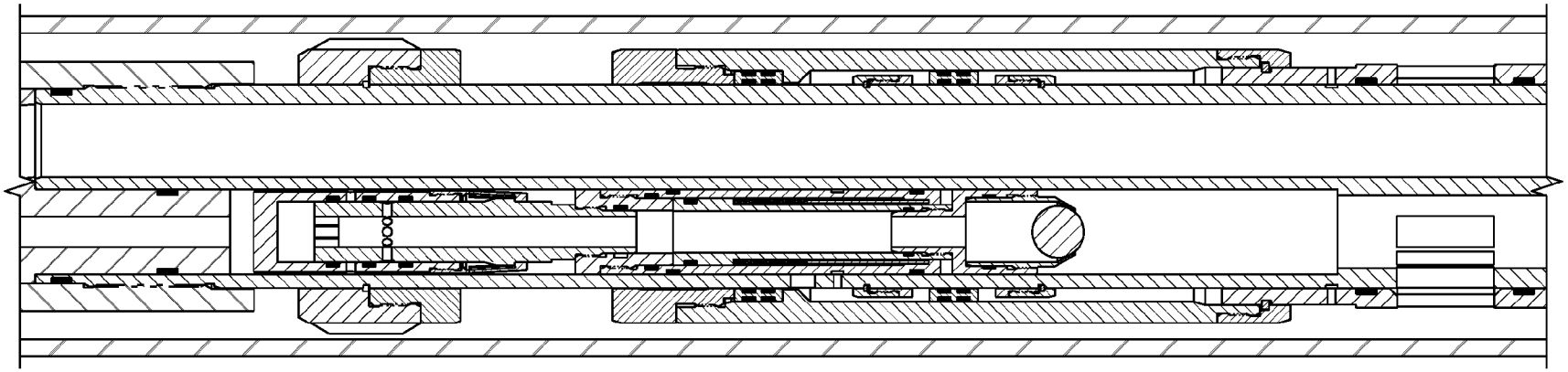
Figure 2C:
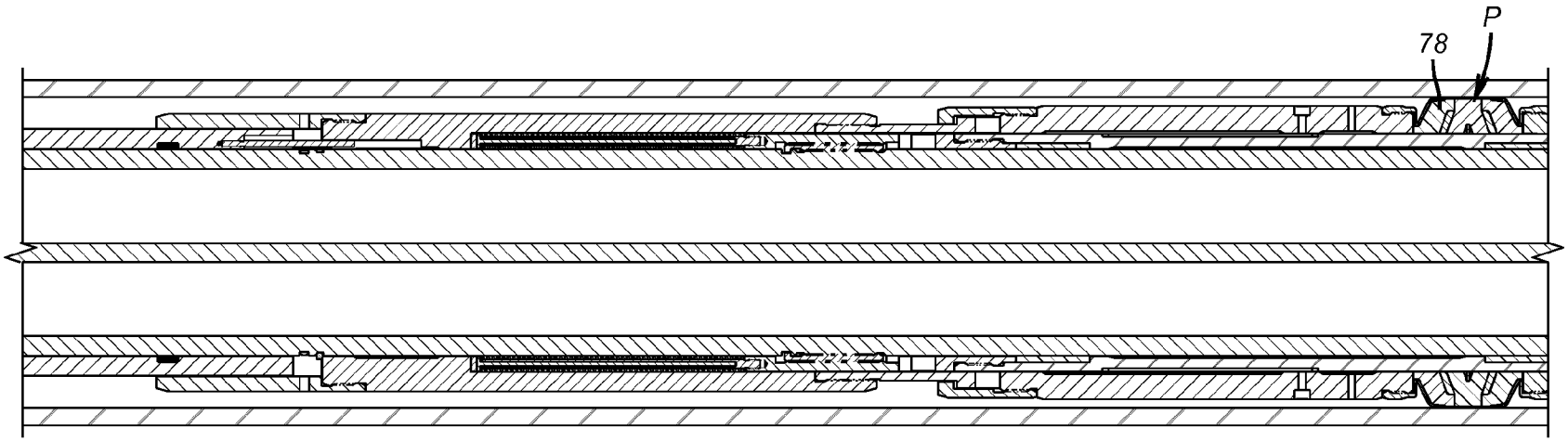
Figure 2D:
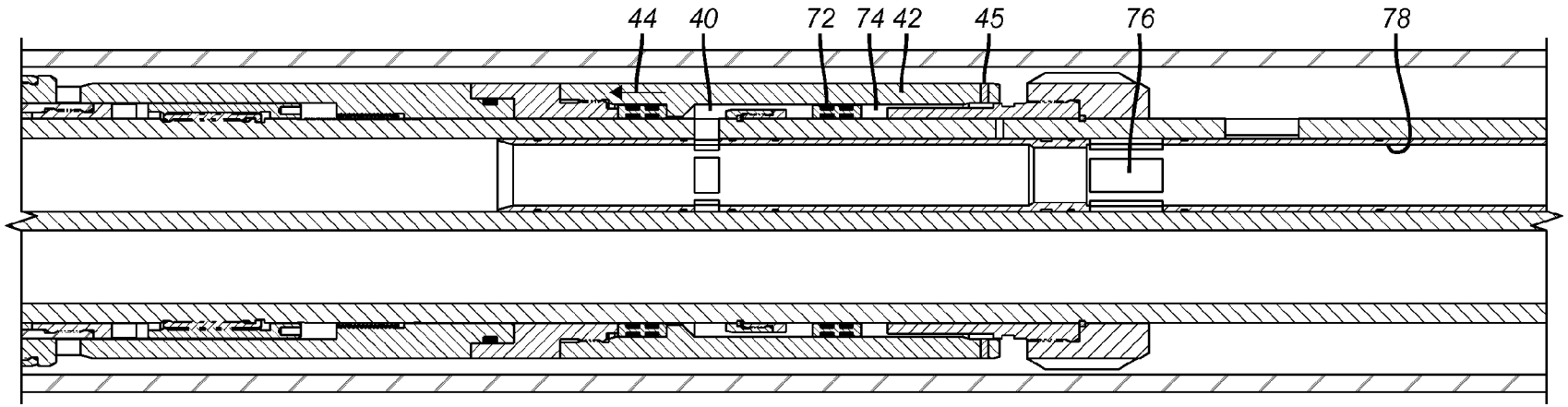
Figure 2E:
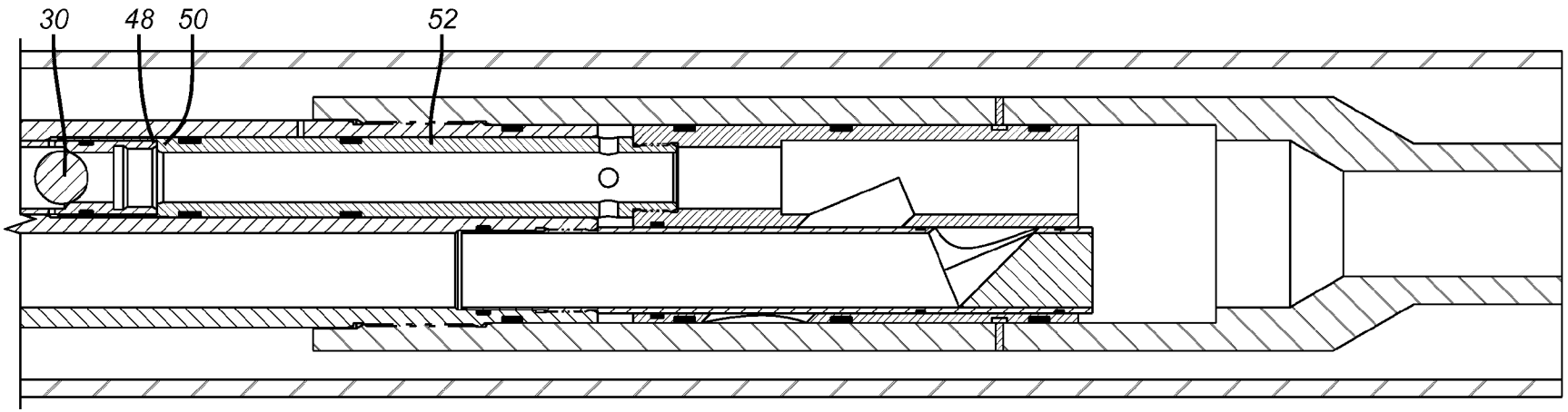

When the liner is properly located generally at the lower end of the previous casing 12 the ball 30 is delivered to seat 18 as shown in FIG. 2*e*. Pressure in bore 14 shears pin 34 and shifts sleeve 36 with ports 38 such that ports 38 align with actuation port 24 so that applied pressure moves piston 42 in the direction of arrow 44 toward the packer element 78, after breaking shear pin 45, to set the packer P. During shifting of sleeve 36 to align ports 38 with actuation port 24, lower end 48 of sleeve 36 lands on upper end 50 of sleeve 52 which is in turn connected to sleeve 54 at thread 56 for tandem movement as will be later described. Sleeve 54 has the lower end 32 of the bore 14. Sleeve 54 also has a lateral opening 58 that is misaligned with opening 60 in sleeve 62. The lower end of sleeve 62 has a diverter plug 64 to block flow until opening 58 and opening 60 align. A travel stop 66 is in the bottom sub 68 of tool T. Openings 58 and 60 ultimately align to form bypass 61 seen in FIG. 3*e* as sleeve 54 is driven to the travel stop 66 by additional pressure on ball 30 which breaks shear pins 80. Sleeve 62 remains fixed to facilitate the alignment between openings 58 and 60.

Figure 3A:
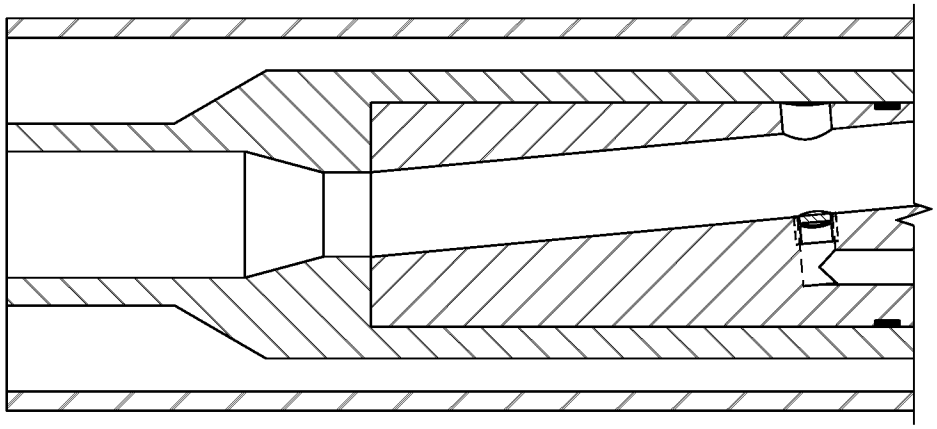
FIGS. 3*a*-3*e* are the view of FIGS. 2*a*-2*e* in the crossover flow configuration.
Figure 3B:
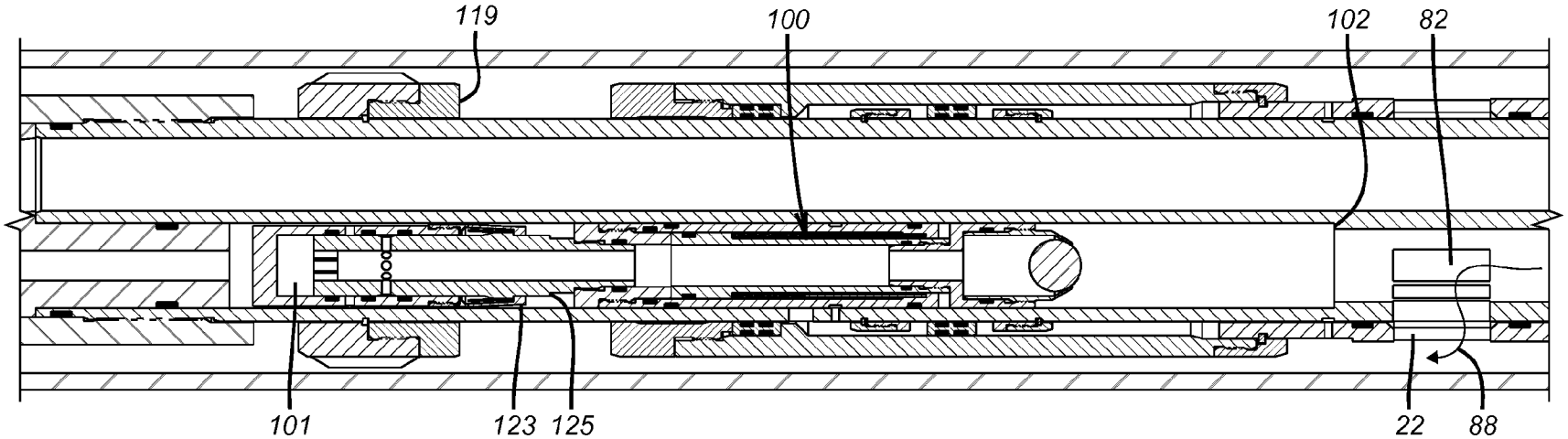
Figure 3C:
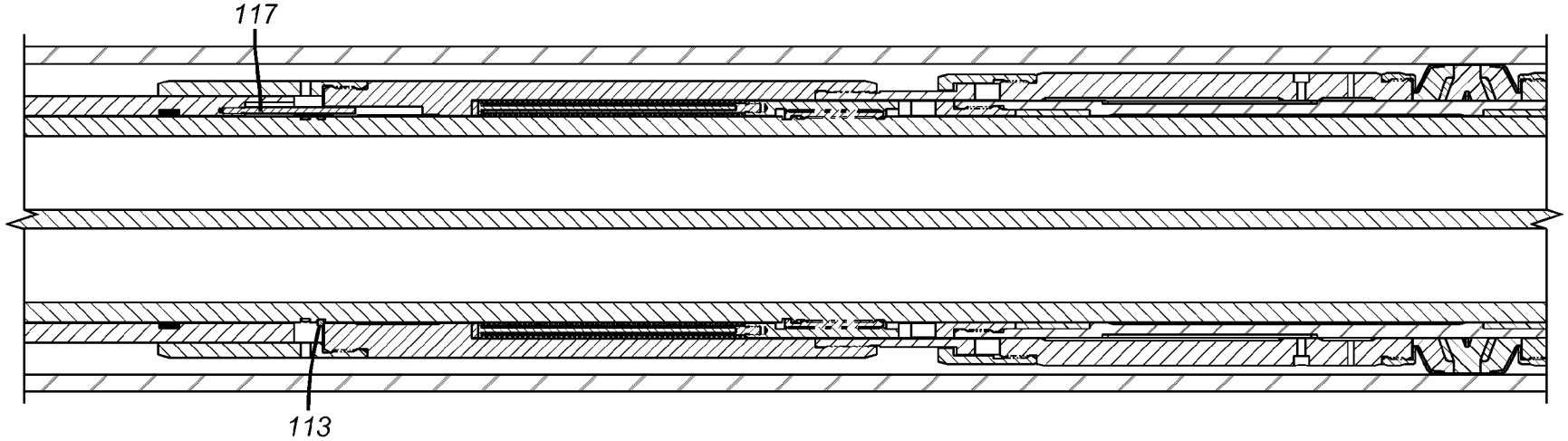
Figure 3D:
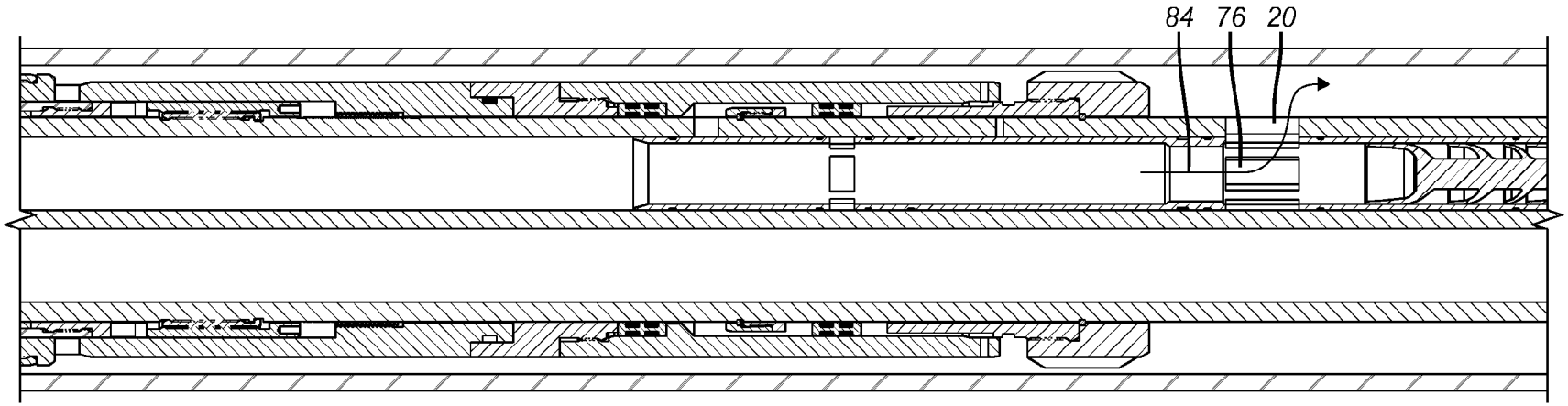
Figure 3E:
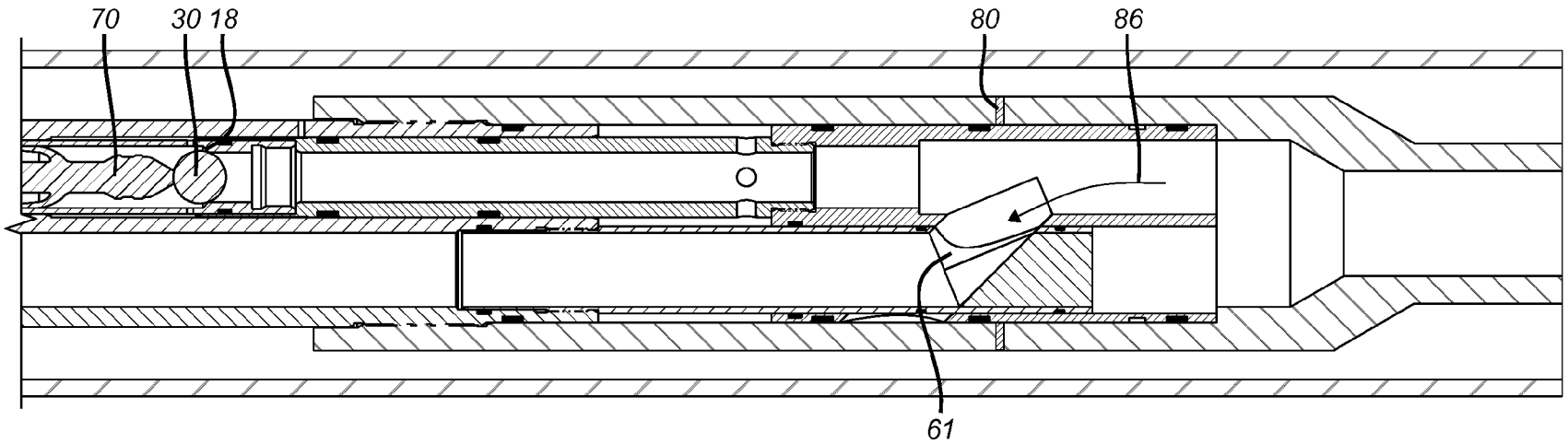
Figure 4A:
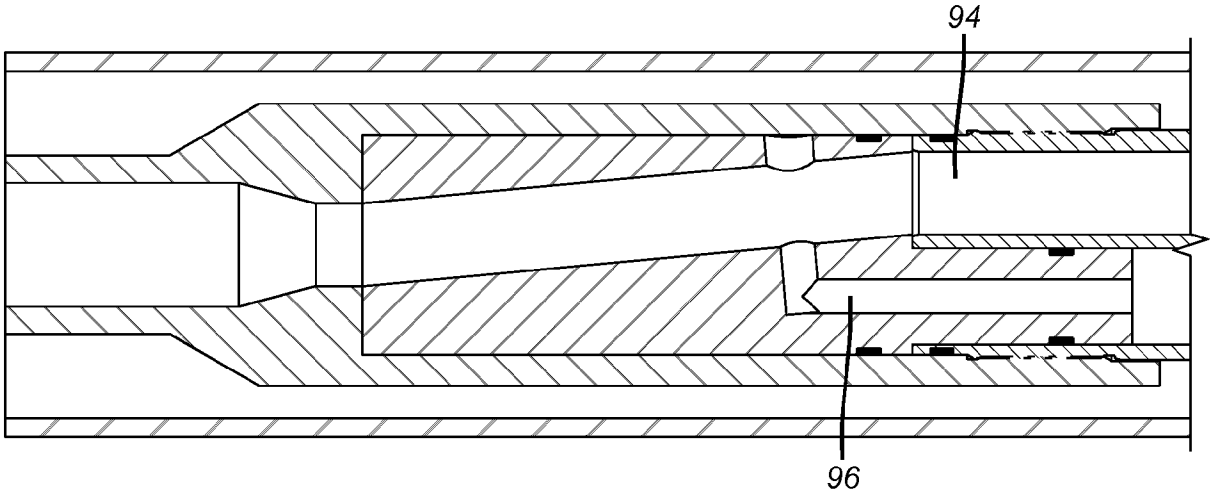
FIGS. 4*a*-4*e* are the view of FIGS. 3*a*-3*e* in the unset packer configuration.
Figure 5A:
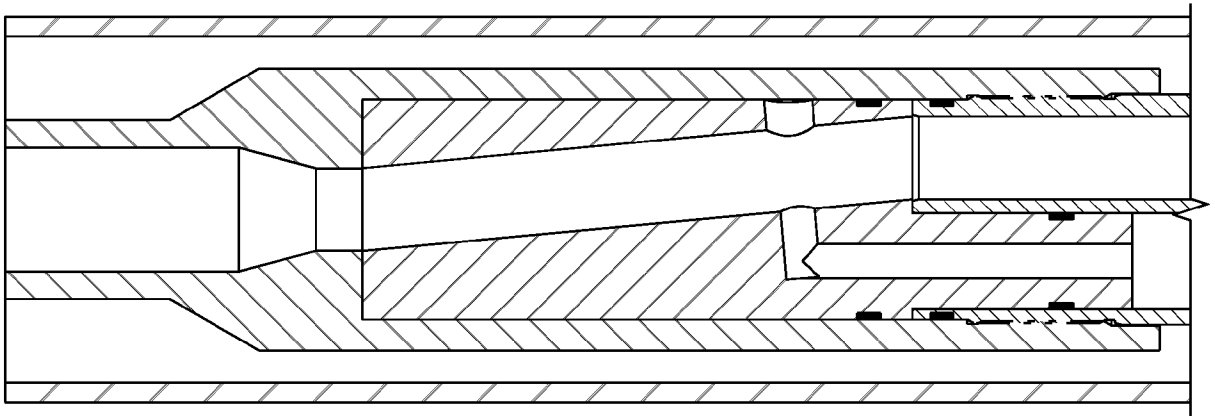
FIGS. 5*a*-5*e* are the view of FIGS. 4*a*-4*e* in the release ball configuration for setting the liner hanger/packer below and releasing for running tool removal.
Figure 4B:
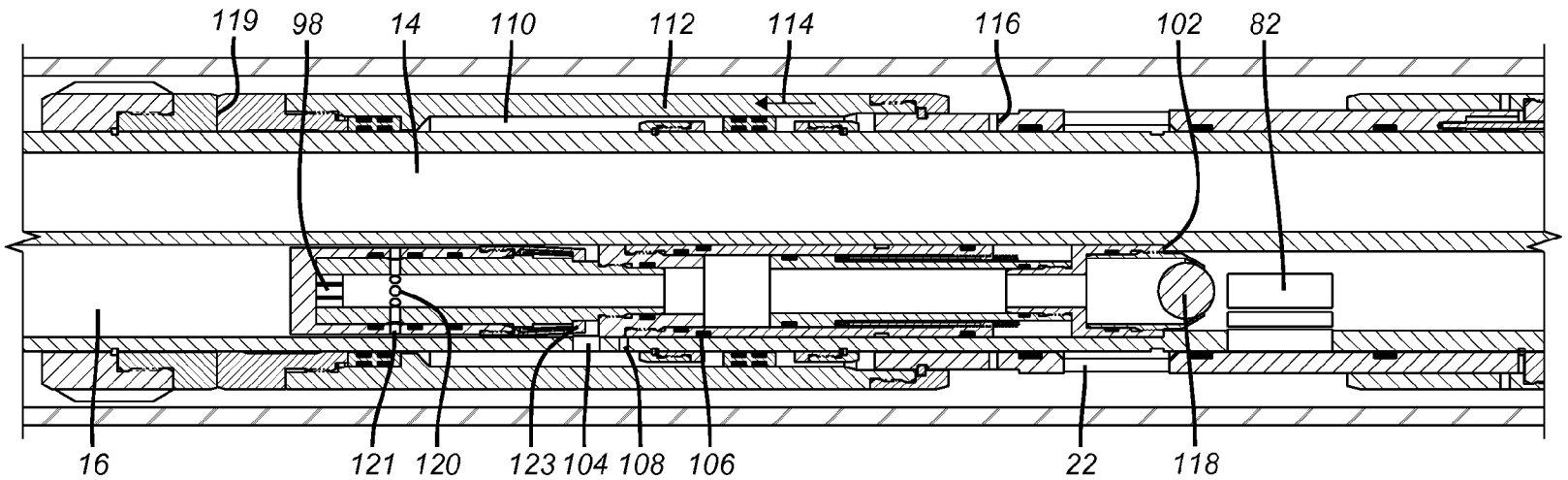
Figure 5B:
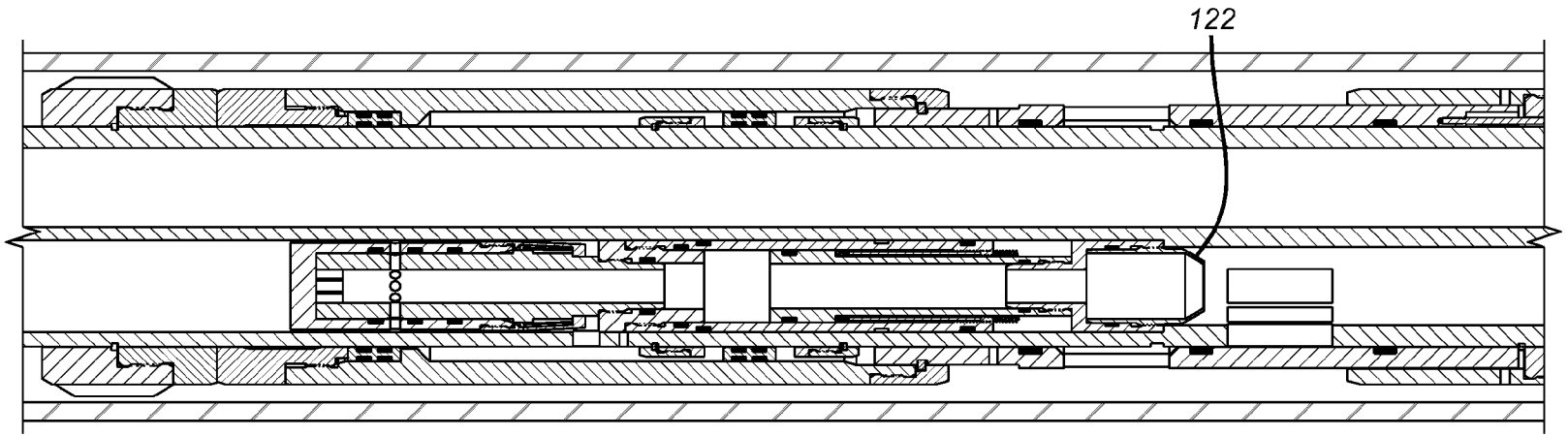
Figure 4C:
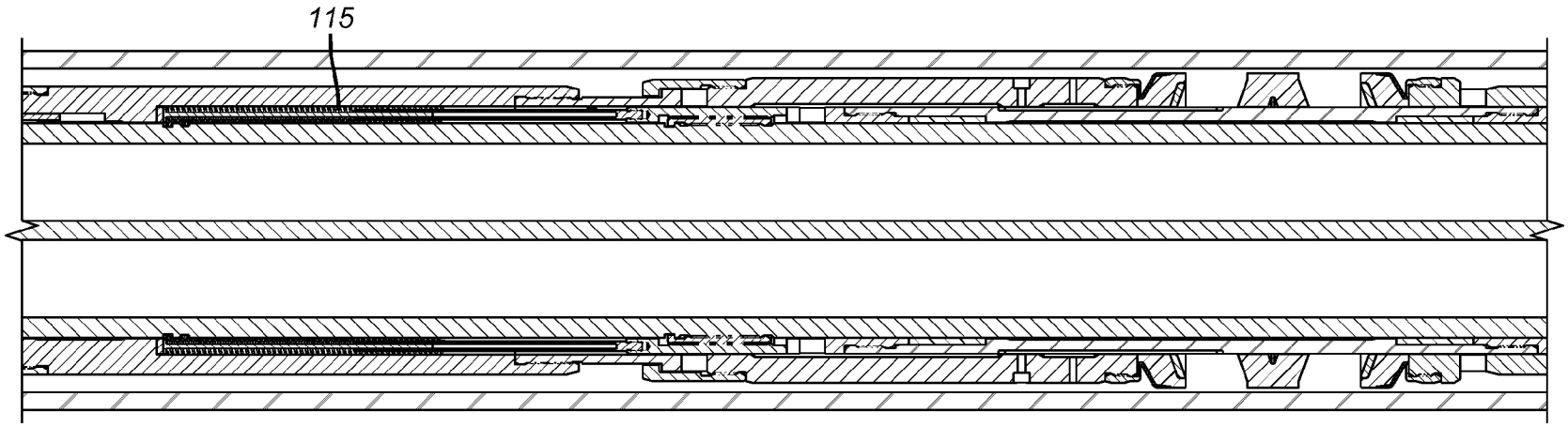
Figure 5C:
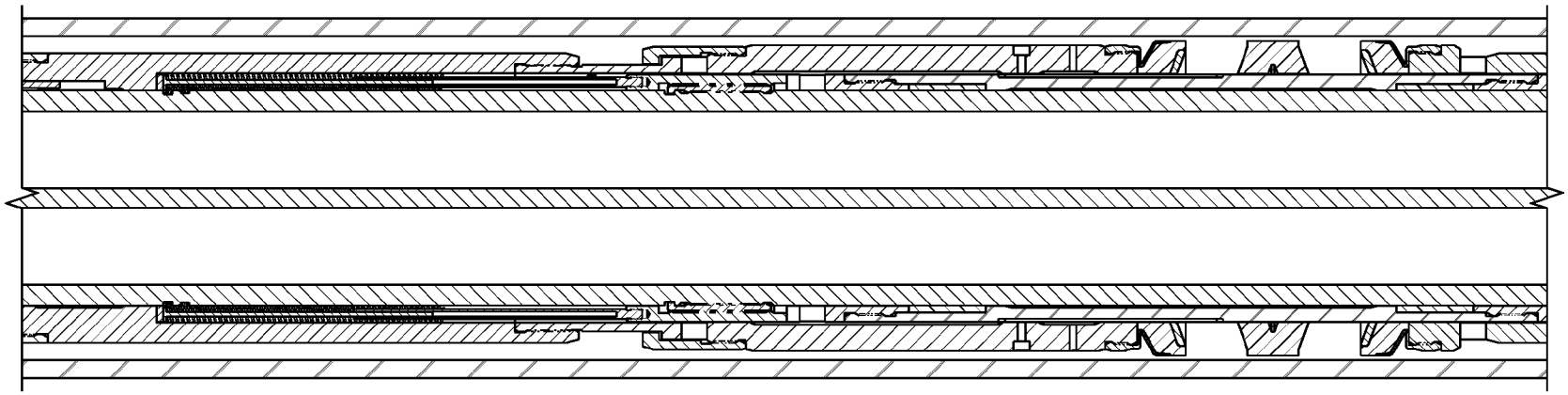
Figure 4D:
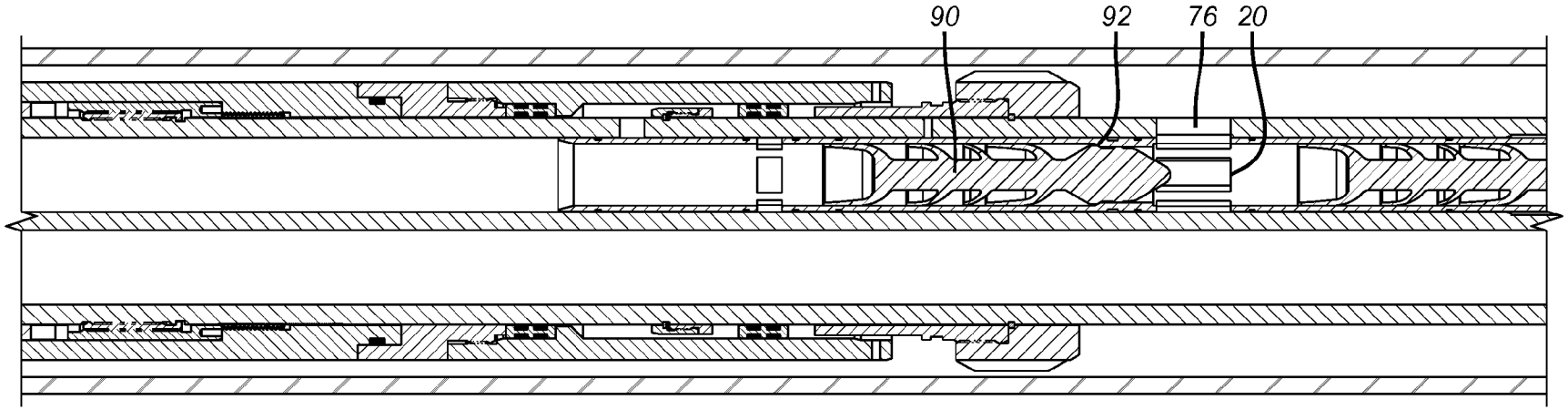
Figure 5D:
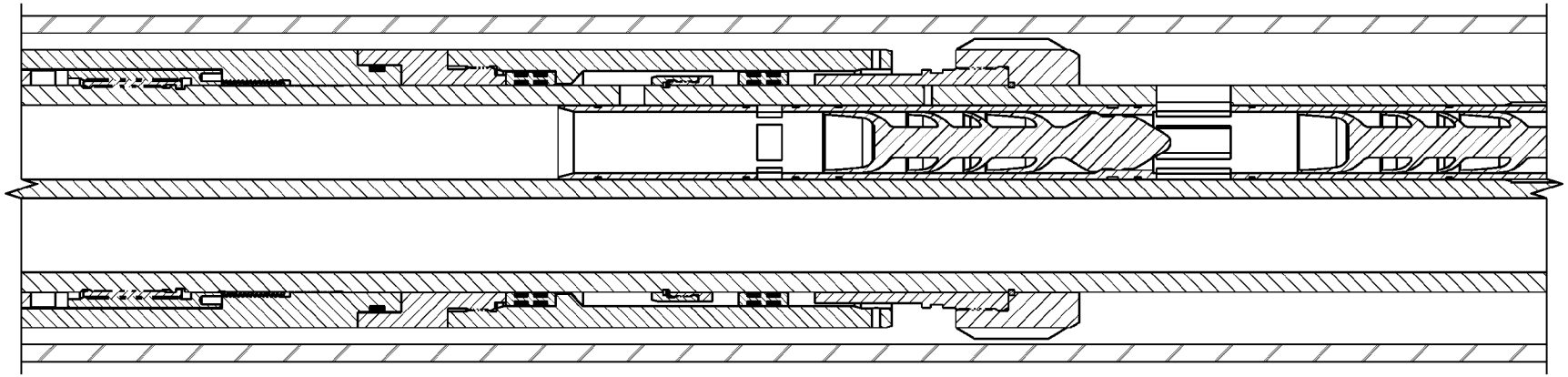
Figure 4E:
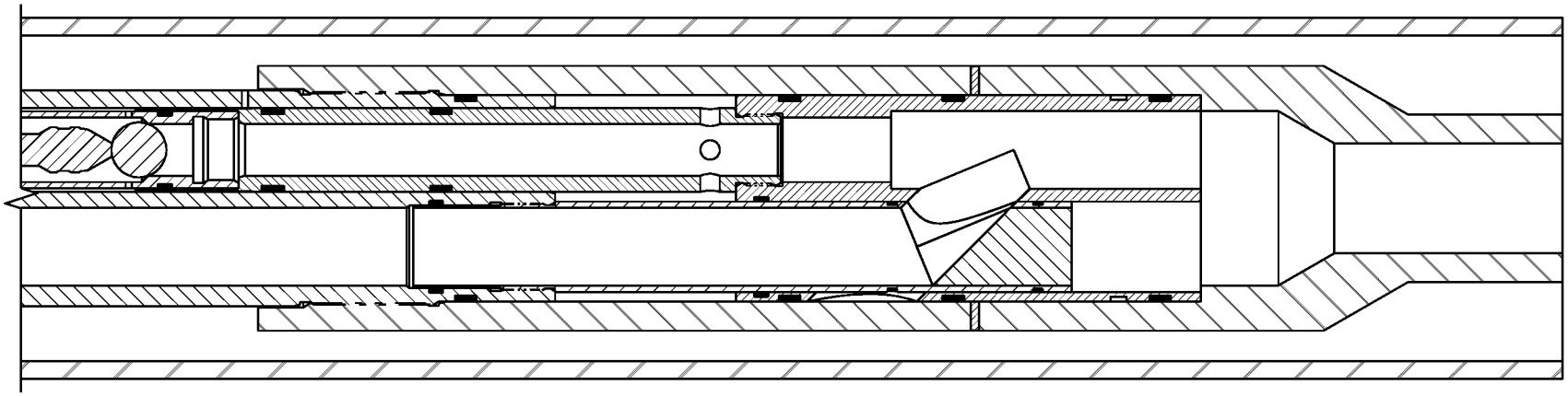
Figure 5E:
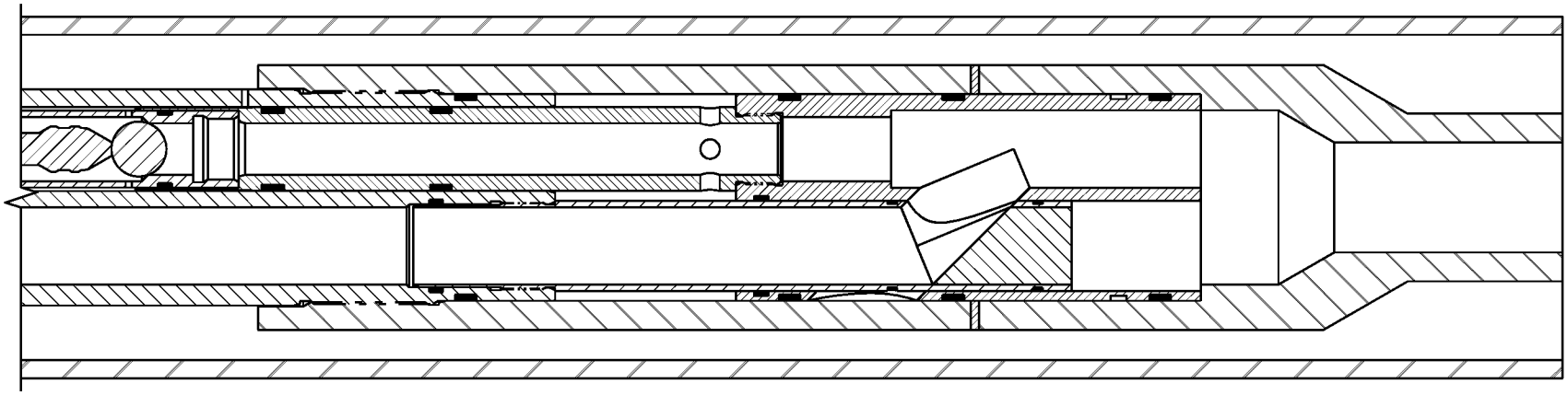
Figure 7A:
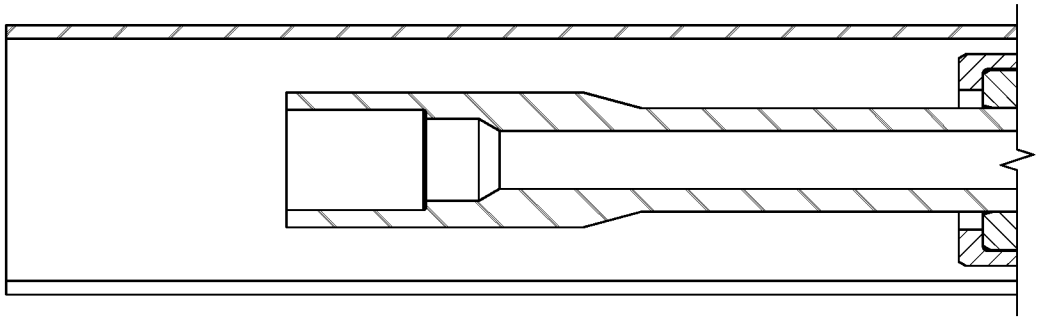
FIGS. 7*a-i* is the view of FIGS. 6*a-i* in the packer set position.
Figure 7B:
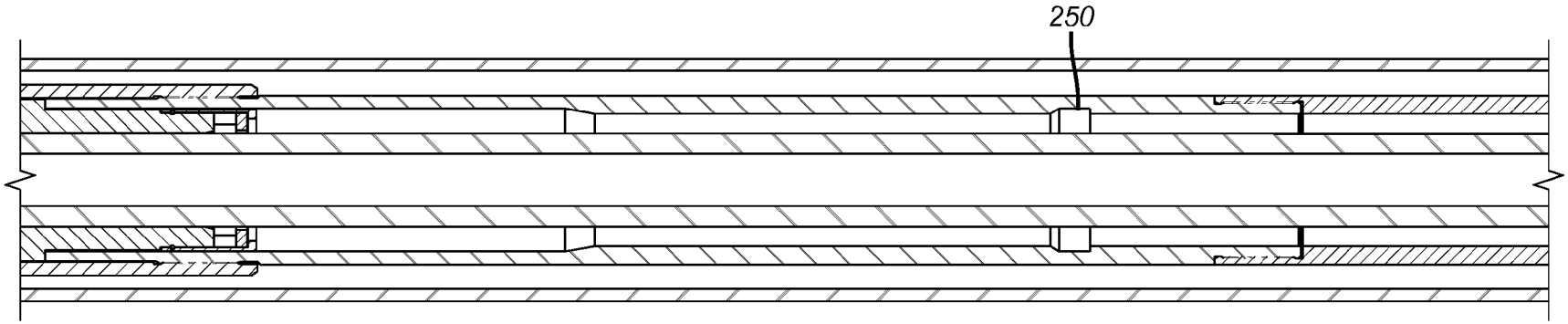
Figure 7C:
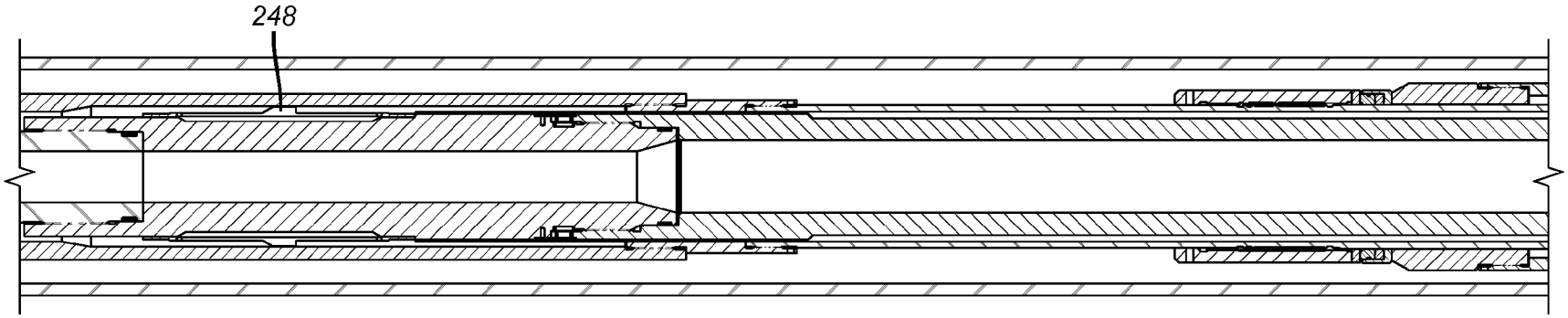
Figure 7D:
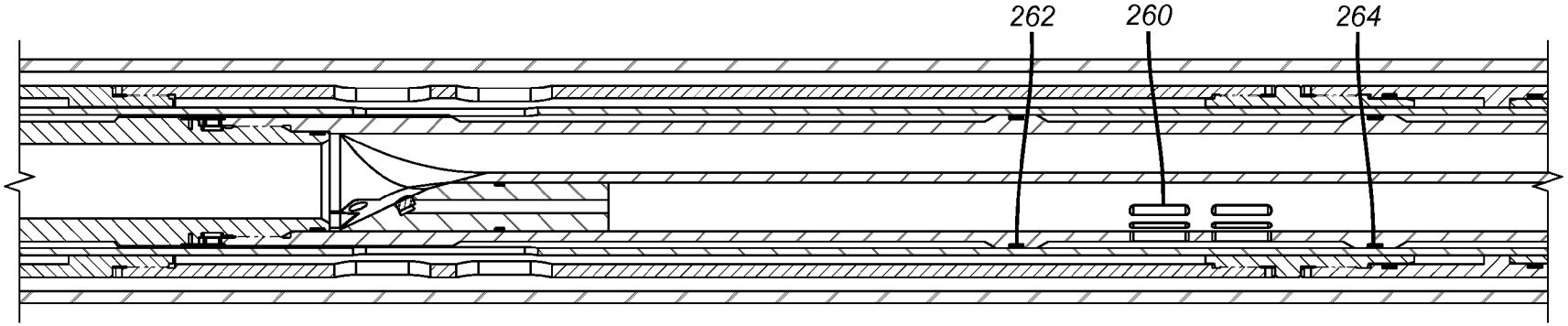
Figure 7E:
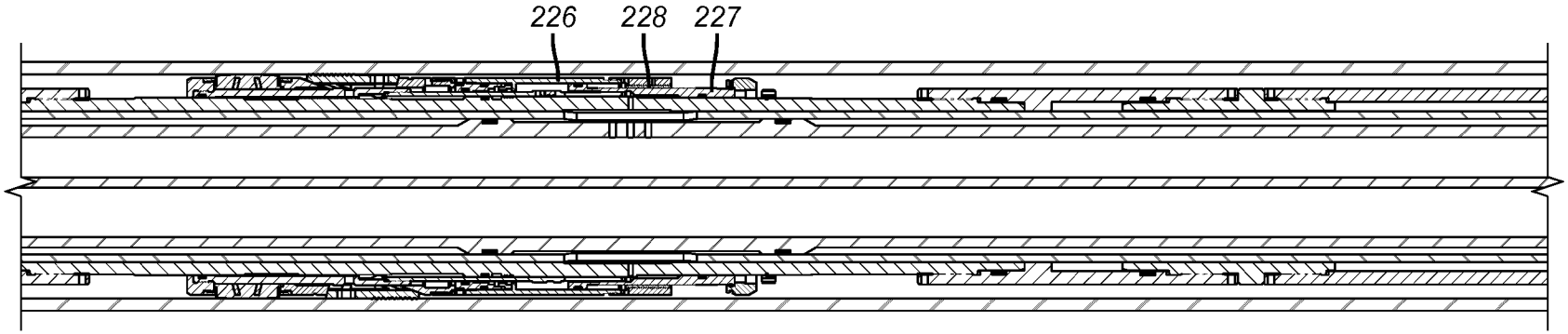
Figure 7F:
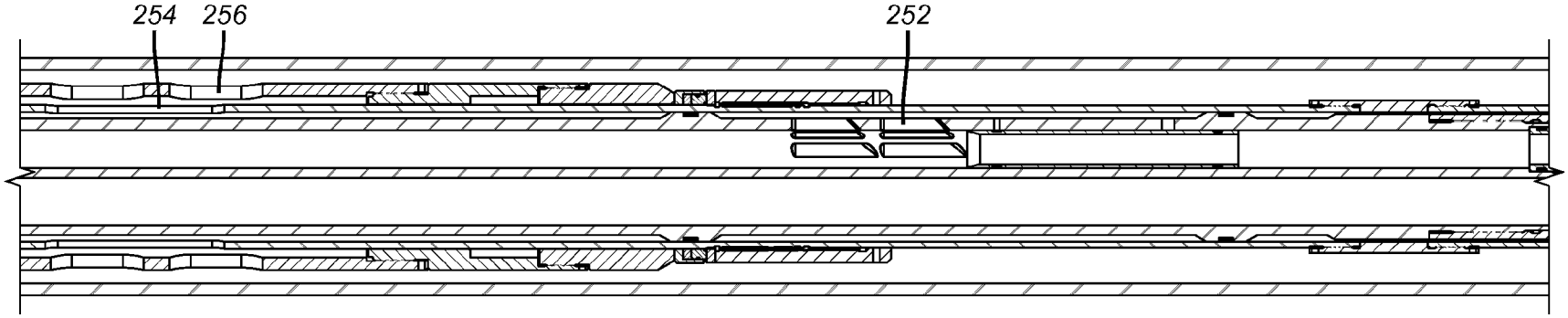
Figure 7G:
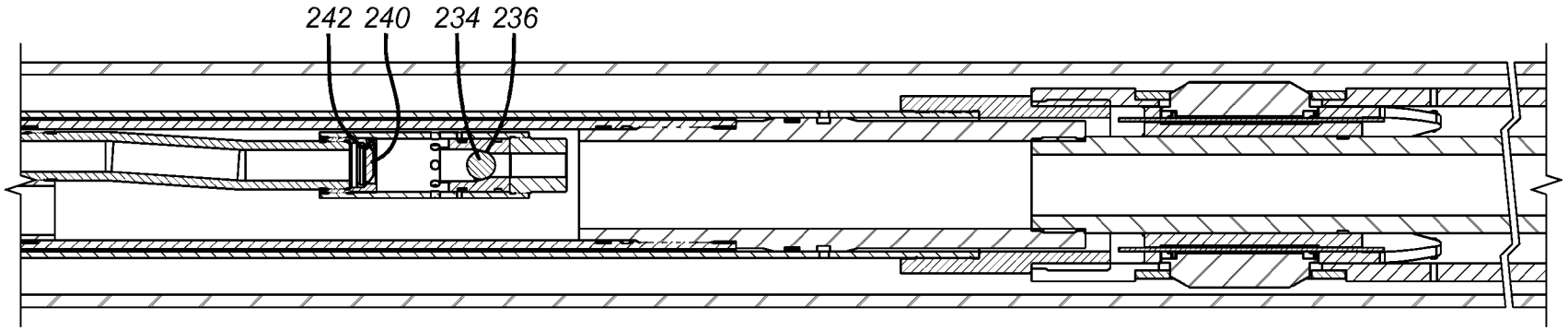

In the FIG. 2 position with ports 38 aligned with actuation port 24 that is closed with thermal and pressure compensating piston 72 an isolated chamber 40 that has atmospheric or low pressure hydraulic fluid. The pressure buildup in chamber 40 moves piston 42 in direction 44 and the seal assembly 78 of the cement packer P is compressed. At this time the cement exit ports 76 are still offset from crossover ports 20 but further pressuring up after the packer P is set moves abutting sleeves 36, 52 and 54 to break shear pin 80. When that occurs ports 76 move into alignment with ports 20 so that when cement is delivered to bore 14 it can exit laterally. The cement is delivered after a leading dart 70 lands on ball 30 as shown in FIG. 3*d*-*e*. Ports 82 in the bore 16 have been run in aligned with housing crossover ports 22, which is where the displaced fluid exits above the now set sealing element 78. The rupture disc 26 is still intact so that in FIG. 3 as the cement is delivered into bore 14 it travels to the aligned ports 76 and 20 to make a lateral exit because bore 14 is now closed with dart 70 sitting on seated ball 30 on seat 18. This cement flow is shown by arrow 84. At the same time heavy fluid that has been pumped in advance of the cement to help retain the cement in the annular space about the liner without entering the liner is displaced ahead of the cement into bore 16 because the cement pressure on ball 30 keeps bore 14 closed and the returning heavy fluid enters bore 16 as indicated by arrows 86. The displaced fluid then crosses over through aligned ports 82 and 22 as indicated by arrow 88.

After the predetermined volume of cement is delivered in the FIG. 3 configuration, the next steps are to set the liner hanger/packer that is not shown and to release the tool T from the cemented liner that is also not shown. To do this, a second dart 90 lands on seat 92 at the end of the cementing operations so that the aligned ports 76 and 20 are effectively isolated from the upper end 94 of the bore 14. Pressure is now applied to break the rupture disc 26 to open up passage 96 that leads to passage 16. The ensuing flow into passage 96 is further impeded by the no shock sleeve 100. A metering device 98 allows hydraulic fluid in space 101 to pass slowly so that ball or sealing object 118 does not get released early from ball seat 122. The newly opened passage 96 allows for the pressuring up on the back end of the no shock sleeve assembly 100 which will break shear pin 108 allowing the no shock sleeve assembly 100 to be shifted until it shoulders out on travel stop 102. Such movement opens up ports 104 as seal 106 shifts past port 104. Pressure applied into annular passage 110 moves piston 112 in the direction of arrow 114 to release and extend the seal assembly 78 of packer P. Initial movement of the piston 112 breaks shear pins 116 allowing further movement of piston 112. The further movement of piston 112 also releases a snap ring 113 by pulling out retaining key 117 to allow springs 115 to retract seal element 78 from contact with the previous casing 12. Further movement of piston 112 in the direction of arrow 114 will shift port 22 to be misaligned with port 82 blocking off flow path 88. Piston 112 will travel in the direction of arrow 114 until it shoulders out on travel stop 119. This pressure buildup to release the cement packer P can happen because the ball 118 is still seated on frangible seat 122 through which ball 118 will ultimately pass when enough pressure is applied. Once piston 112 has shifted until it has shouldered out on travel stop 119, the remaining hydraulic fluid left in space 101 is pushed through metering device 98 aligning ports 120 with ports 121 to increase flow bypass through the no shock sleeve assembly 100. When ports 120 and 121 align collet 129 will latch onto shoulder 125 which locks ports 120 and 121 in alignment. With the cementing packer P unset further pressure buildup will force ball 118 through seat 122 as shown in FIG. 5 so that the released ball 118 will land in the liner hanger/packer that is not shown for setting it in a known manner and for releasing the tool T also in the known manner. The tool T is now pulled out of the hole and excess cement can be washed out through the standard flow path through passage 96 and bore 16 from tubular to annular flow. Cement is then allowed to set up after which the hole can be extended and the process repeated with another liner or the hole can be completed and put into production.

Rotation of the tool T with the packer P set is enabled by bearings 121, 123, 131, and 132 which allow all the components not fixated by the sealing effect of the seal assembly 78, when set, to relatively rotate while the cement is delivered. Rotary seals 133 and 134 beneath packer P allow for a pressure differential across packer P while relative rotation occurs between packer P and dual bore mandrel 15.

FIGS. 6-9 is another embodiment that has some similarities to the embodiment described above but has some mandrel manipulation to assume the necessary positions for accomplishing top down cementing. It will be described in a more abbreviated manner assuming the detailed discussion above of the first embodiment has provided a general background as to the tool configuration for top down cementing.

A mandrel 200 supports an outer housing 202 on opposed bearings 204 and 206 so that when a cementing packer 208 is set, the mandrel 200 can rotate relatively to the outer housing 202 components held fixed by the set packer 208. Inside the mandrel 200 is a body that defines the cementing bore 210 and the displaced fluid bore 212. A rupture disc 214 isolates the top of bore 212 from bore 210 at junction 216. Bore 210 has lateral openings 218 located between seals 220 and 222 for access through ports 224 and 225 to set the packer 208. This is done by pushing up the pistons 226 and 227, and locking the piston movement with lock ring 228 so that the sealing element 230 is against the surrounding casing 232. Bore 210 can be pressurized by landing ball 234 on seat 236 and building pressure. At a predetermined pressure the packer 208 is set and the seat 236 moves against tubular travel stop 238 so as to release the flapper 240 that is spring loaded to rotate against a seat 242. With flapper 240 on the seat 242 flow up bore 210 is cut off.

Figure 8A:
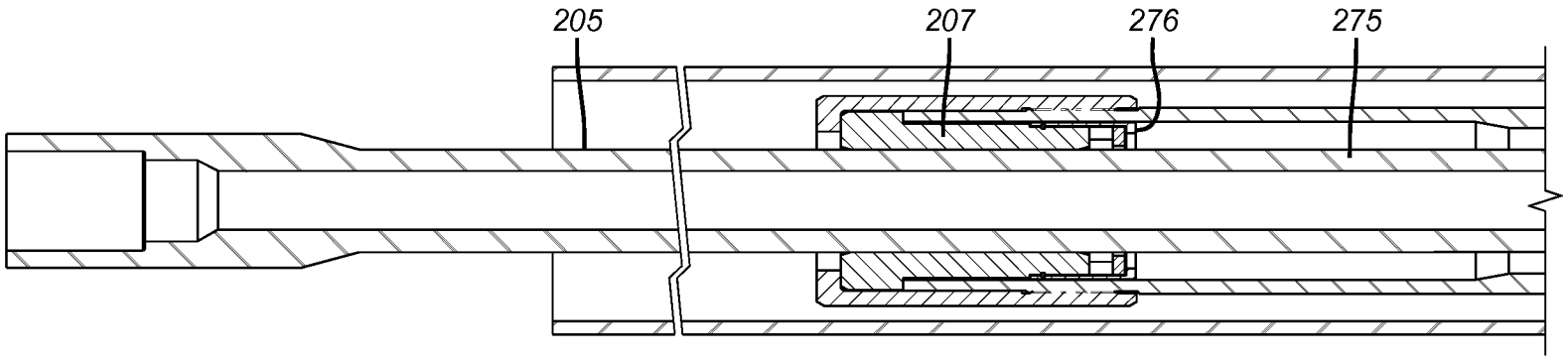
FIGS. 8*a-i* is the view of FIG. 7*a-i* in the cementing position.
Figure 8B:
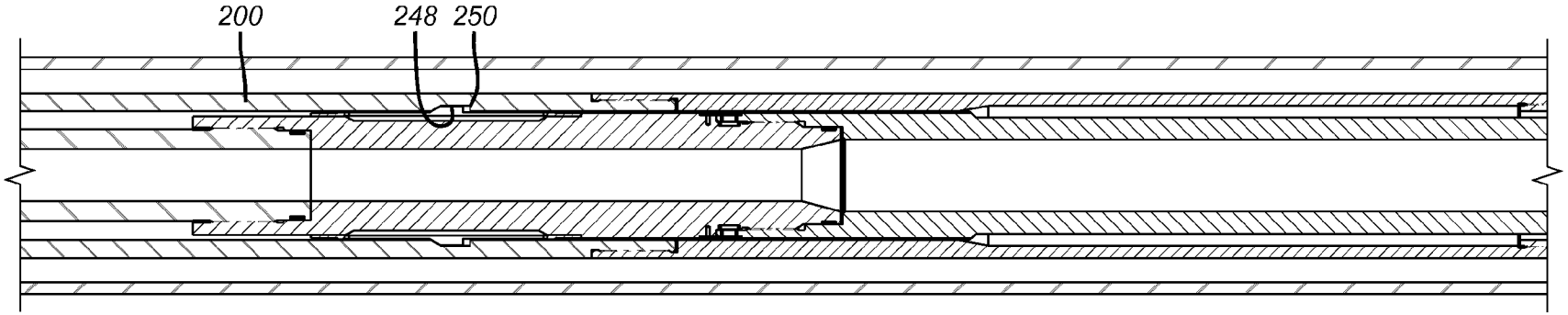
Figure 9B:
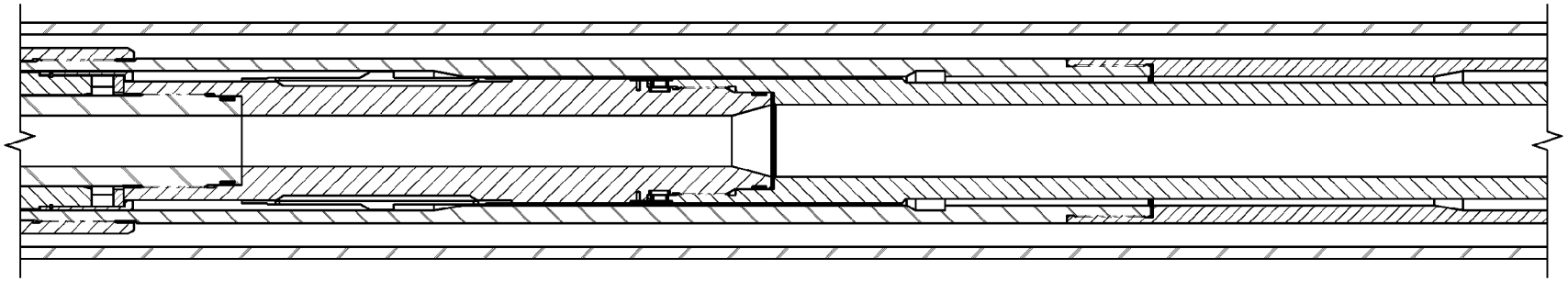
Figure 8C:
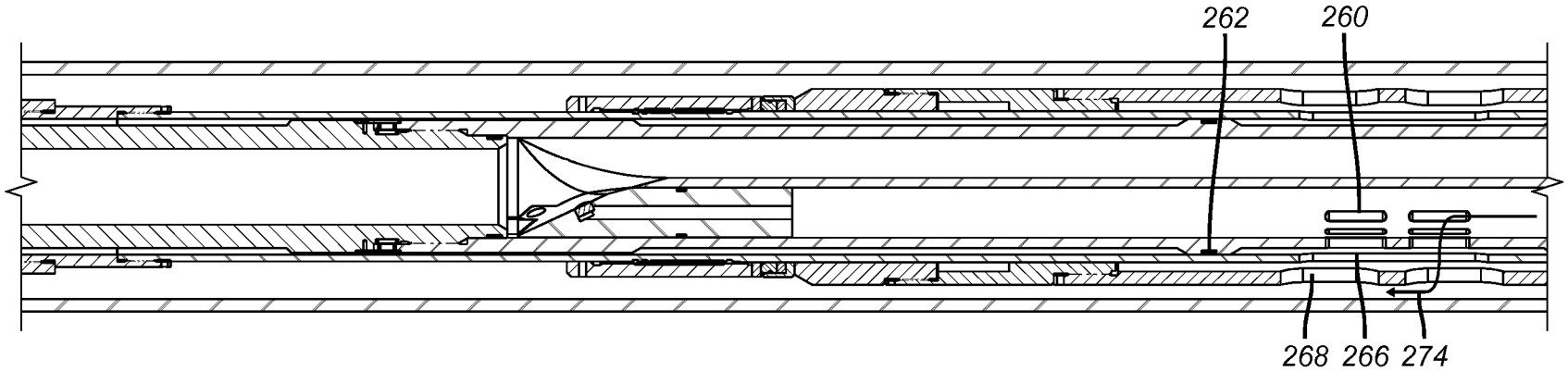
Figure 9C:
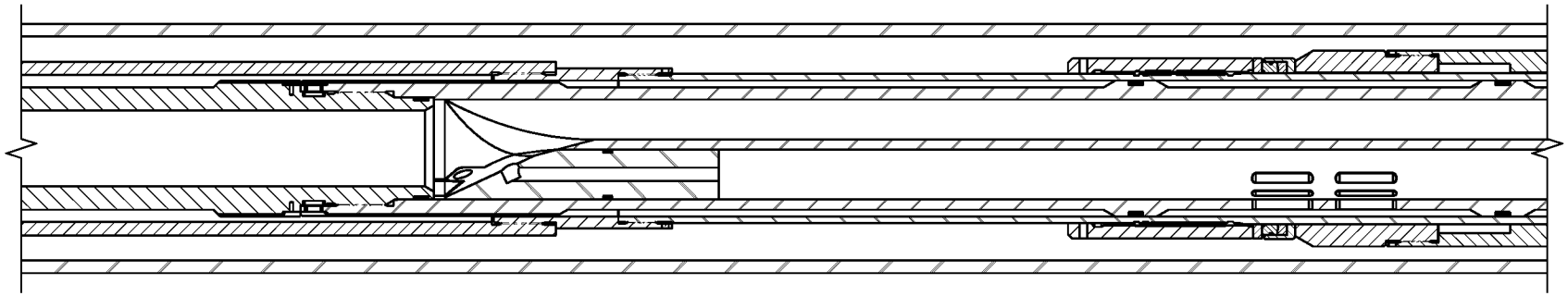
Figure 8D:
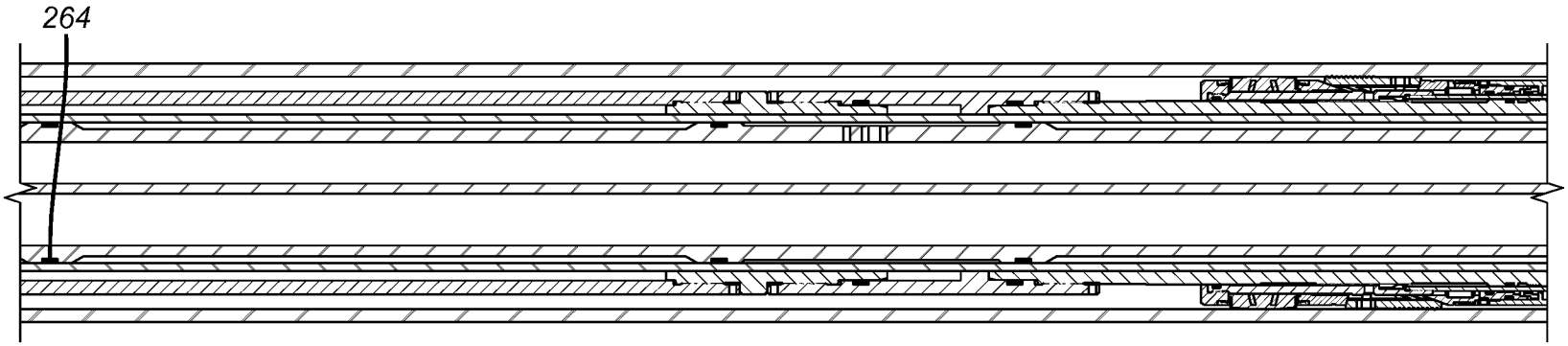
Figure 9D:
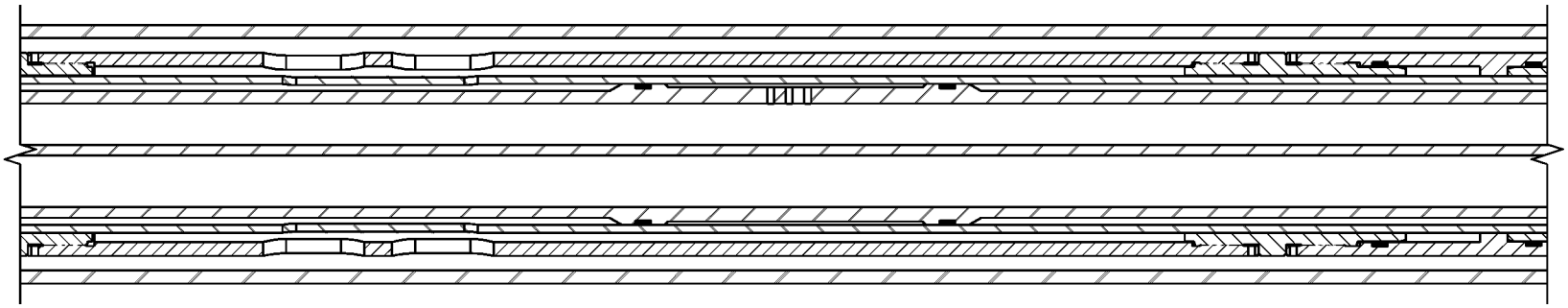
Figure 8E:
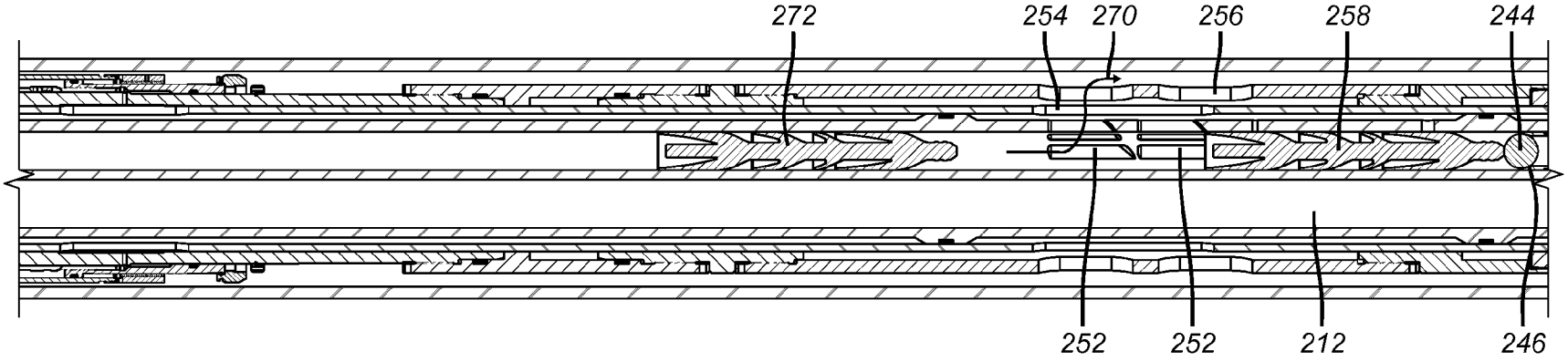
Figure 9E:
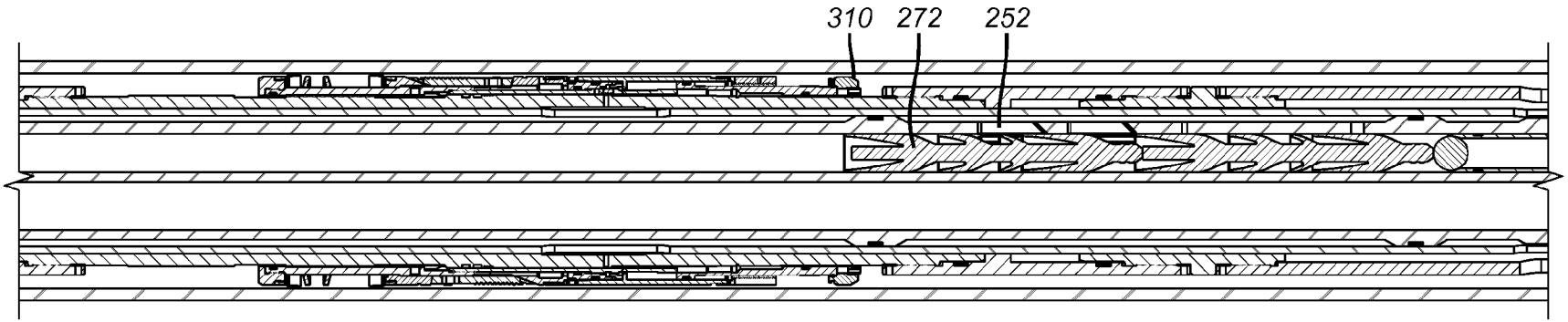
Figure 8F:
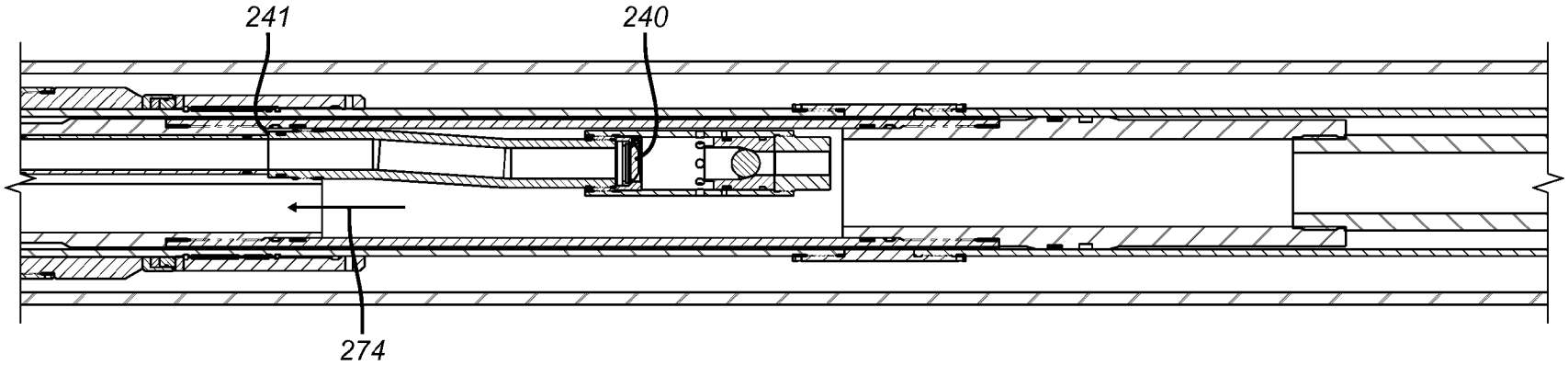
Figure 9F:
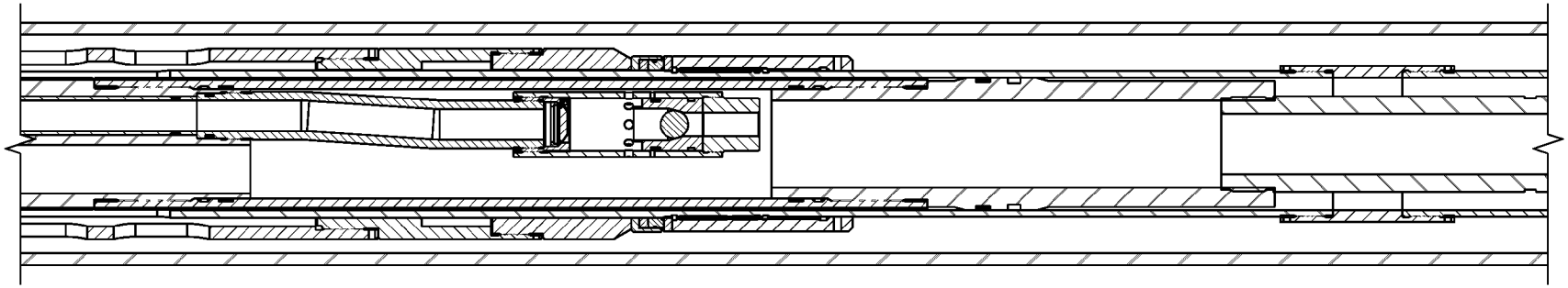
Figure 8G:
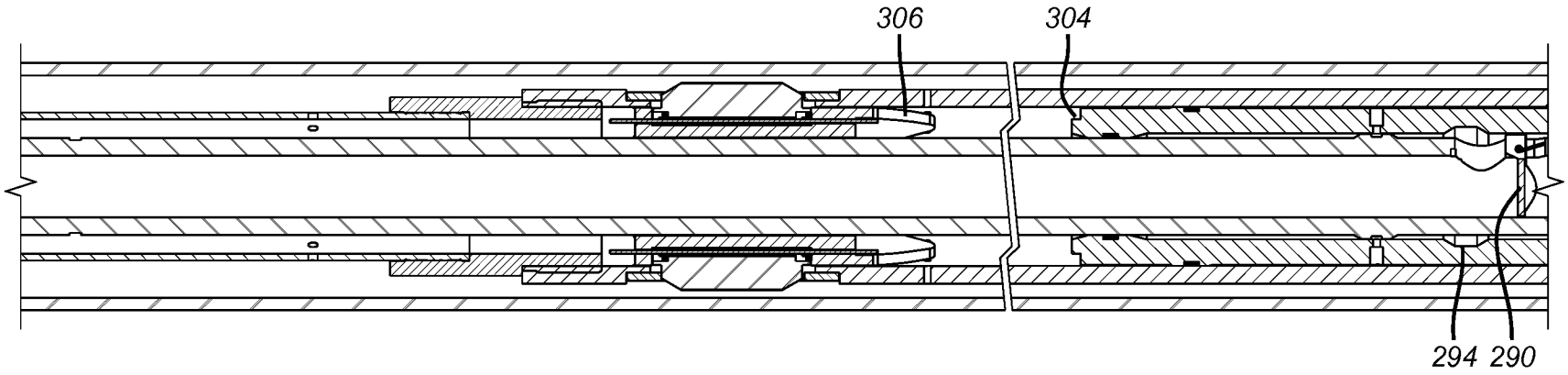
Figure 9G:
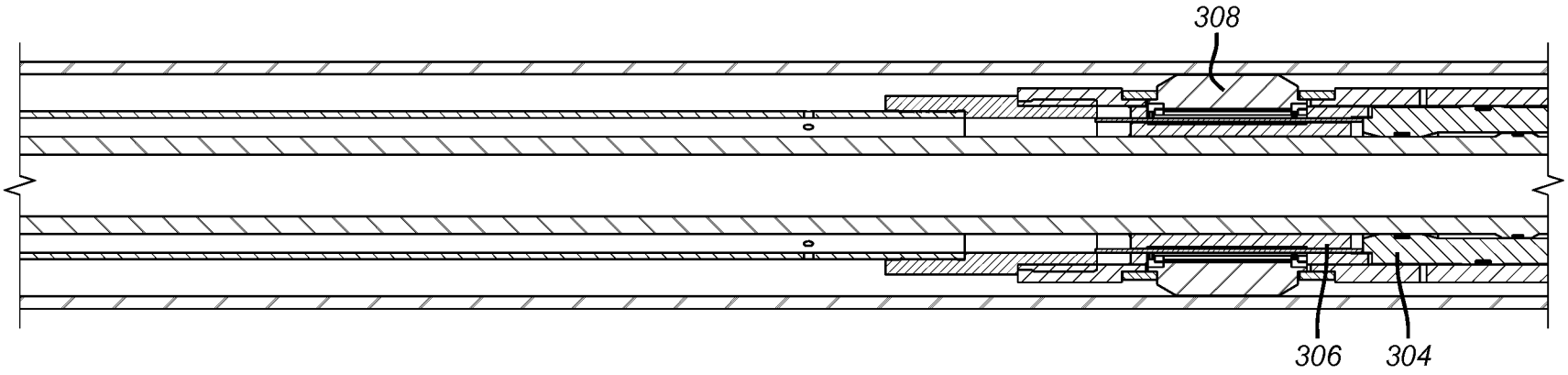
Figure 8H:
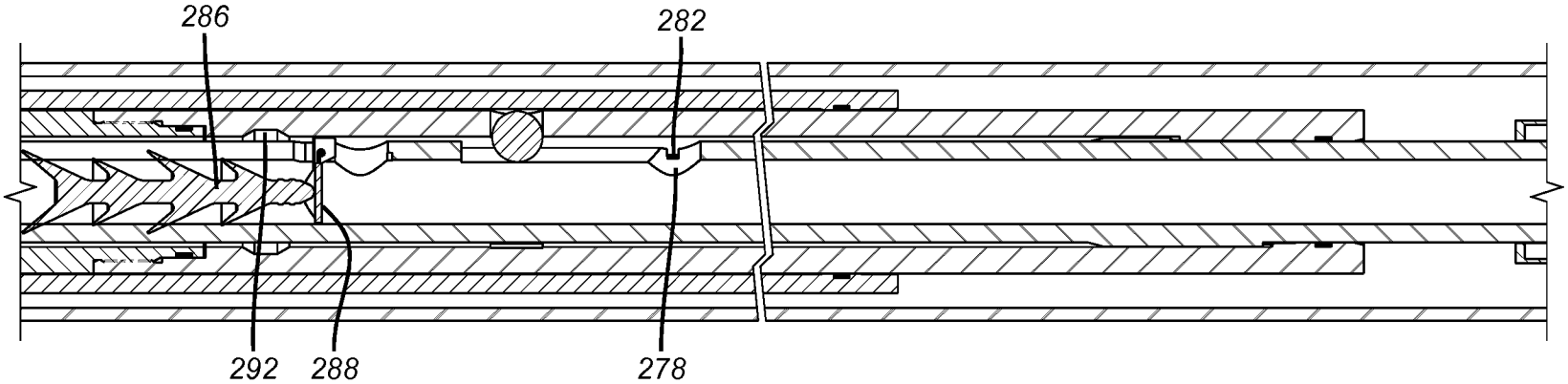
Figure 9H:
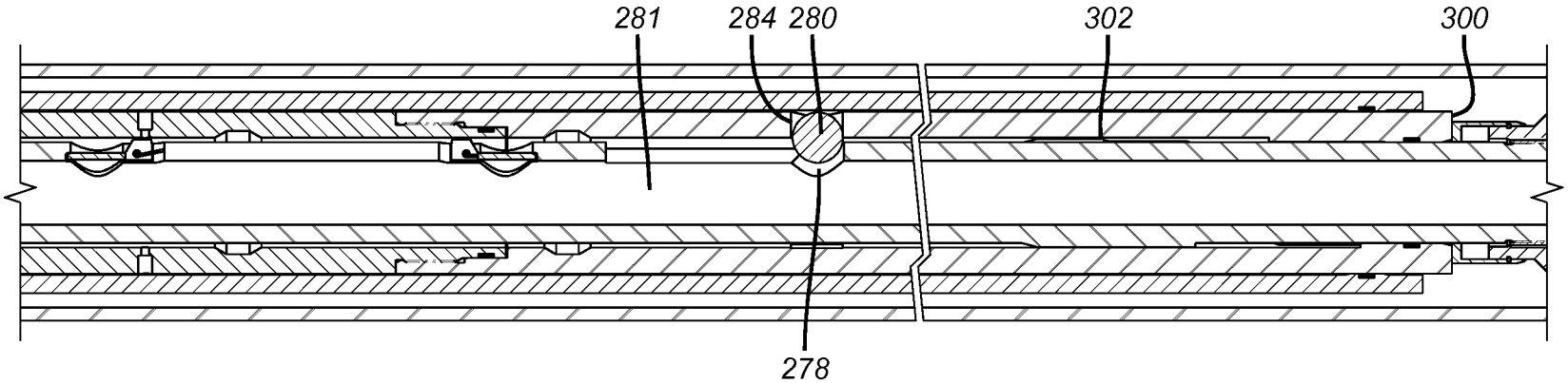
Figure 8I:
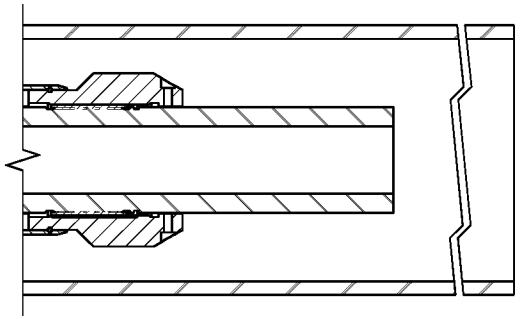
Figure 9I:
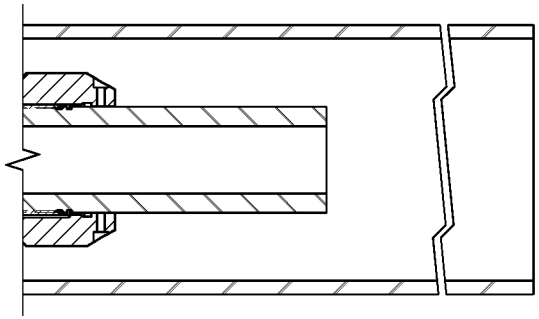

The mandrel 200 is split into two components: an axial shifting mandrel 201 and a rotary sleeve 203. The axially shifting mandrel 201 can shift axially with respect rotary sleeve 203 but are rotationally locked by torque stinger 205 and lock block 207. The rotary sleeve 203 portion of mandrel 200 is axially locked to the outer housing 202 through retainers 209 and 211 which support bearings 204 and 206. The axial shifting mandrel 201 is picked up to the point of collet 248 landing in groove 250 as shown in FIG. 8*b*. This movement raises openings 252 in bore 210 to slots 254 in the axially shifting mandrel 201 where the slots 254 were already aligned with openings 256 in the outer housing 202. The same picking up movement of axial shifting mandrel 201 lifts openings 260 in bore 212 that are located between seals 262 and 264 into alignment with slots 266 which are already aligned with openings 268 in outer housing 202 as shown in FIG. 8*c*. A second ball 244 is dropped on seat 246, as shown in FIG. 8*e* to block off any additional flow from passing by the flapper 240 and shifts seat 246 until it shoulders out on travel stop 241. A dart 258 is landed on ball 244 prior to pumping cement. At this time, after the heavy fluid is delivered the cement can be delivered right behind the heavy fluid to exit laterally as indicated by arrow 270 keeping in mind that the second dart 272 is delivered behind the predetermined quantity of cement. This effectively closes ports 252 with dart 272 as shown in FIG. 9*e*. The displaced fluid comes up bore 212 because flapper 240 closes off bore 210 to flow in the up-hole direction. Arrow 274 shows the crossover exit of this fluid above the seal 230 for the trip up-hole in the upper annulus above the cement packer 208.

Figure 6A:
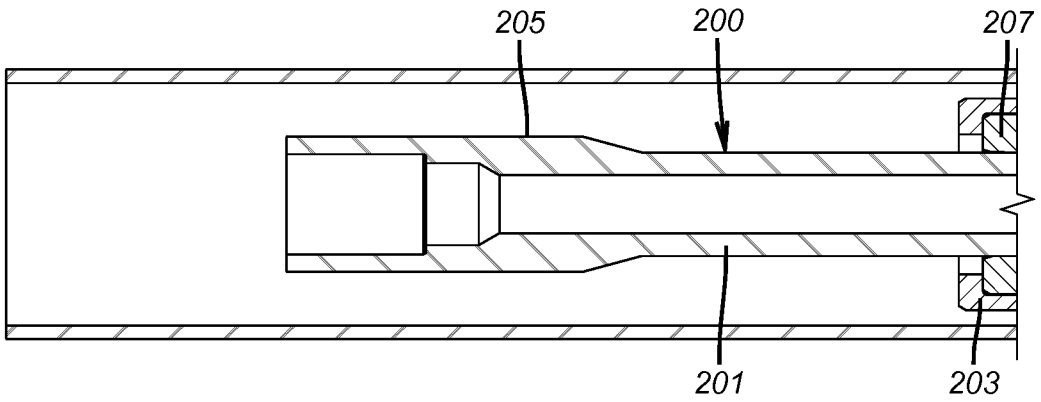
FIGS. 6*a-i* is an alternative embodiment in the run in position.
Figure 6B:
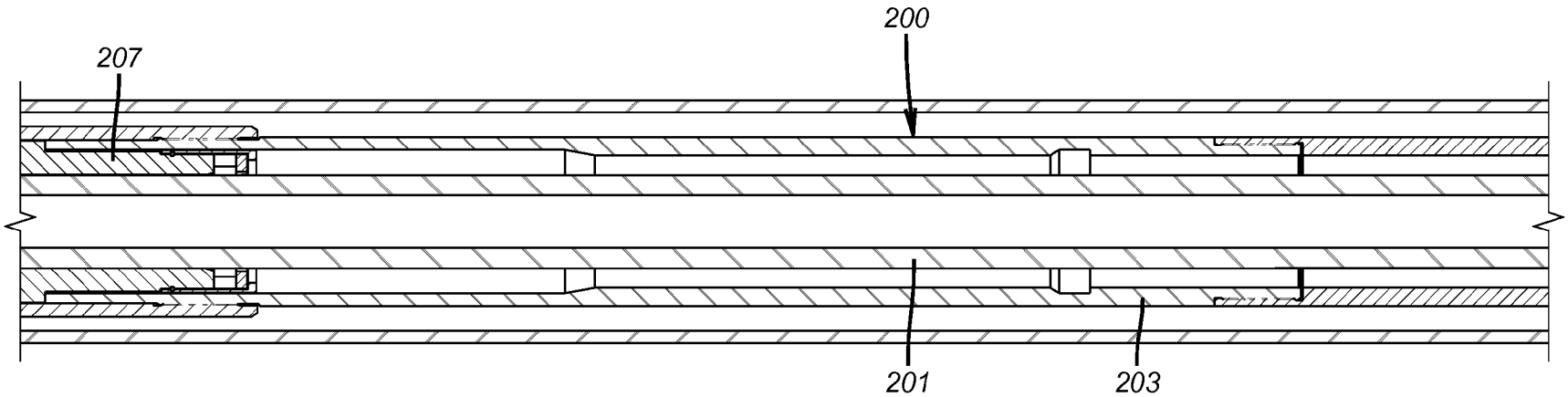
Figure 6C:
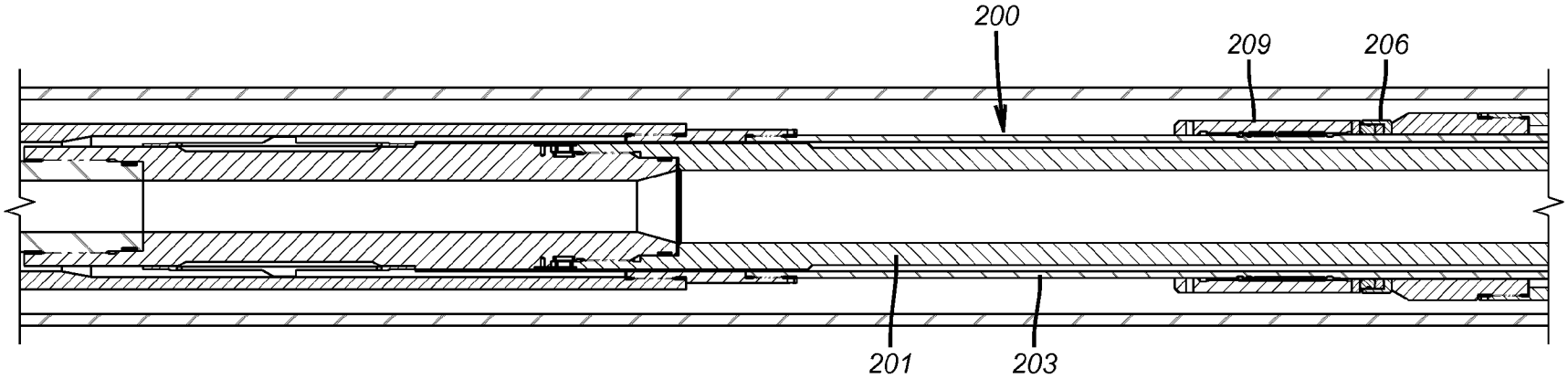
Figure 6D:
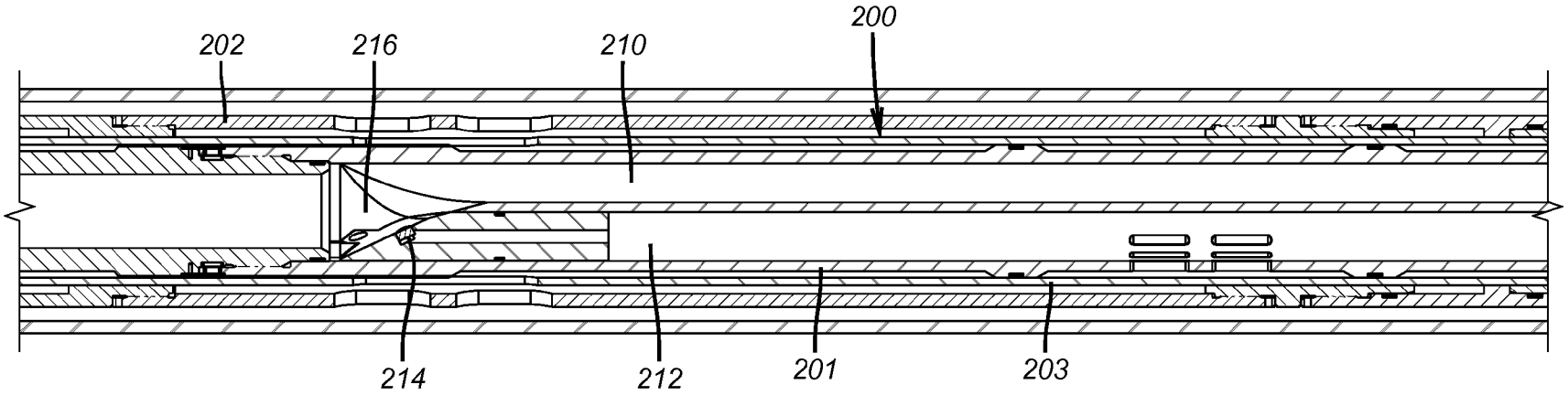
Figure 6E:
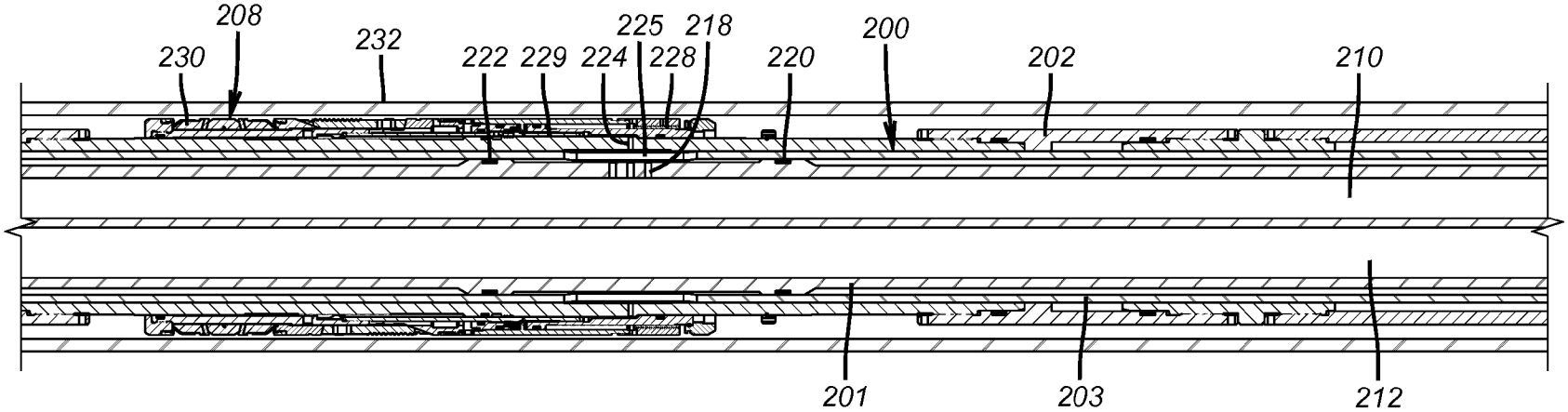
Figure 6F:
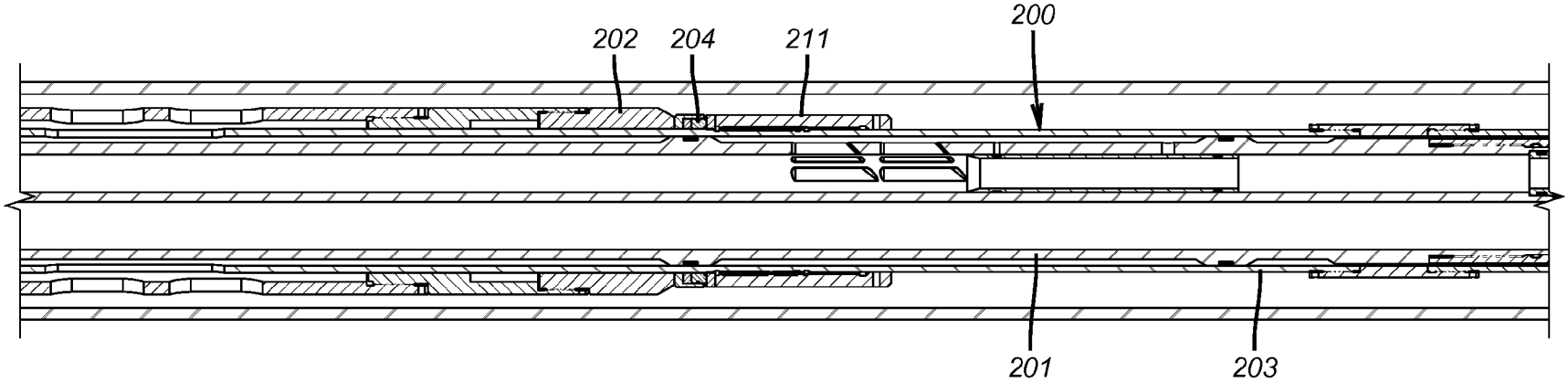
Figure 6G:
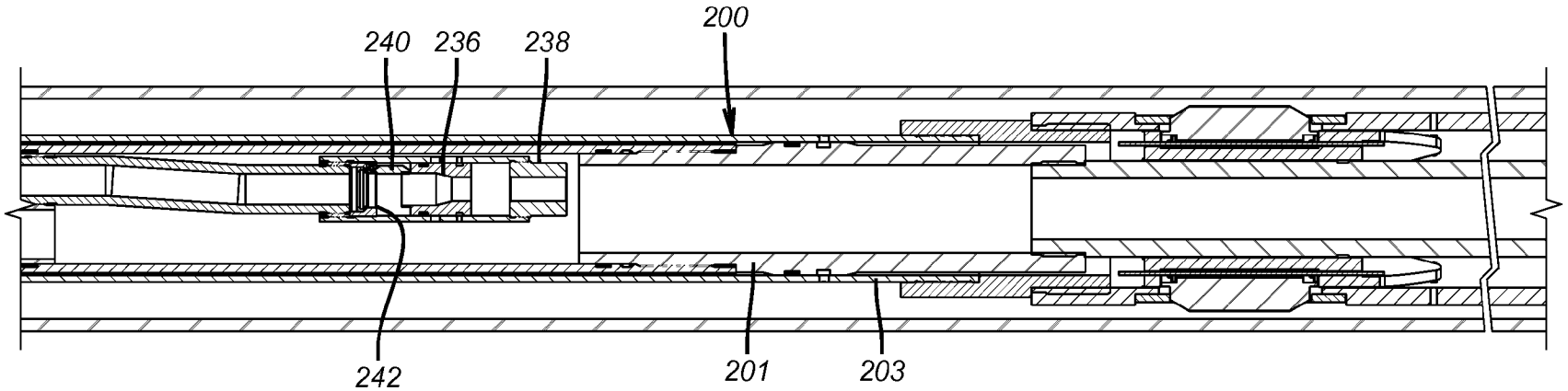
Figure 6H:
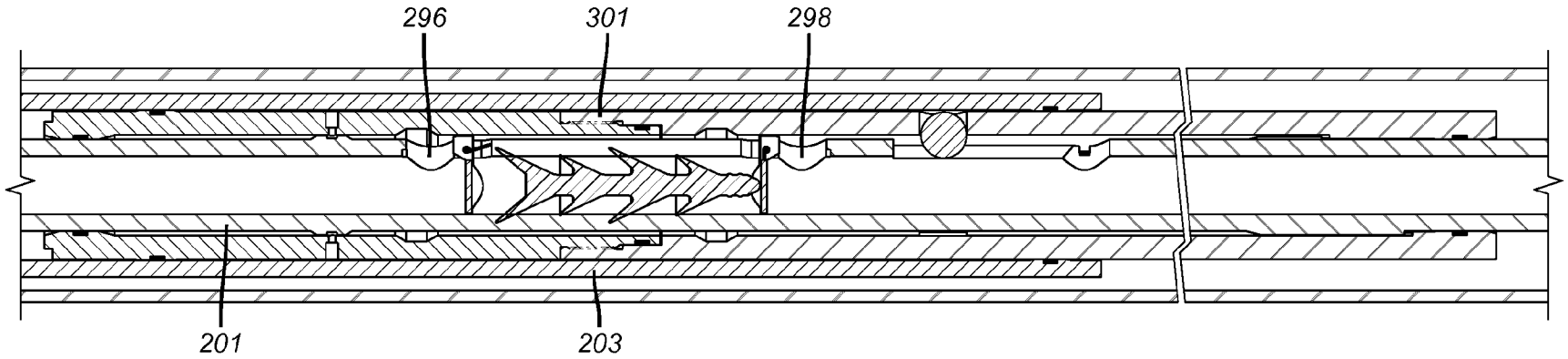
Figure 7H:
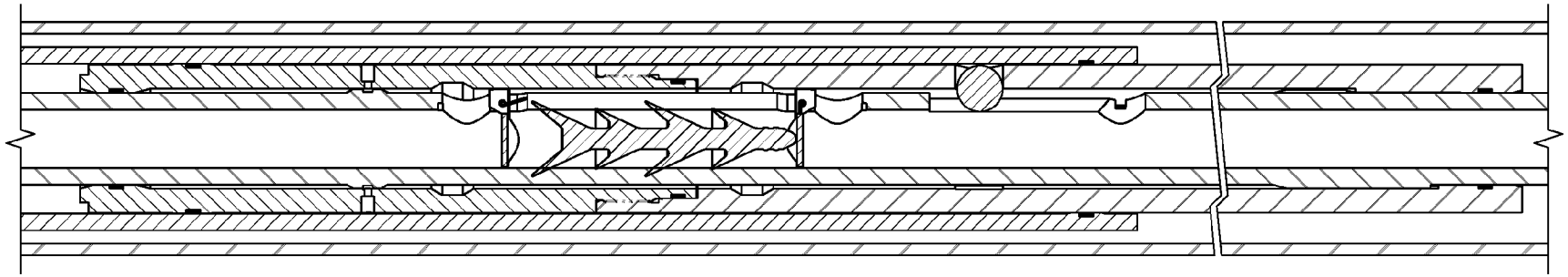
Figure 6I:
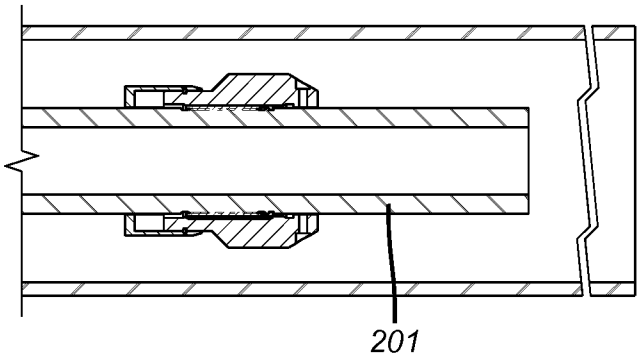
Figure 7I:
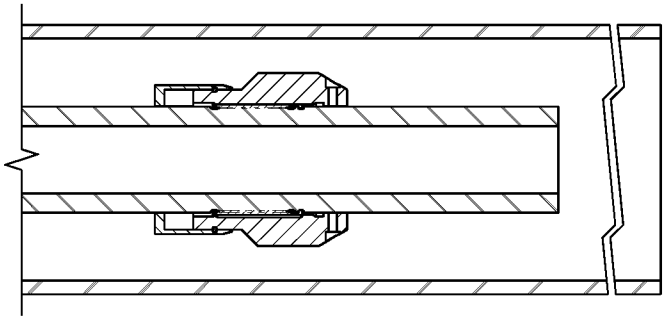
Figure 9A:
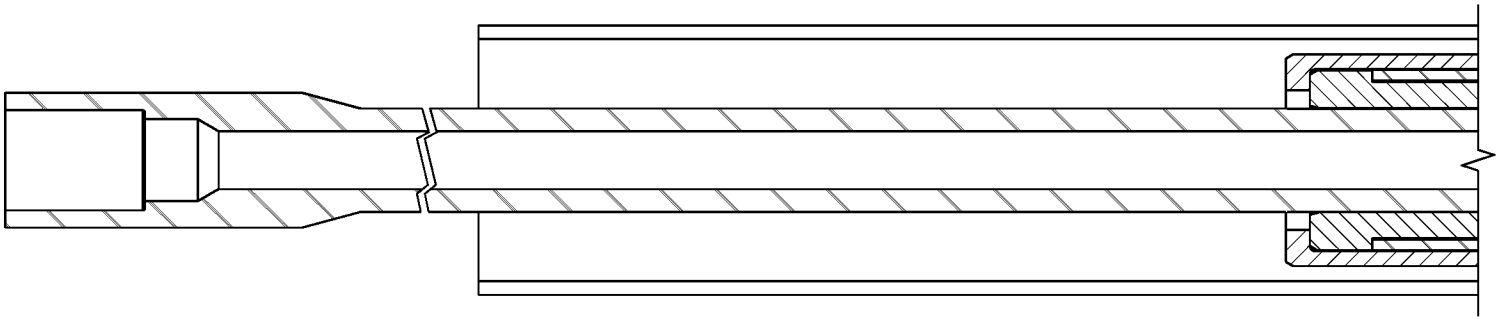
FIGS. 9*a-i* is the view of FIGS. 8*a-i* in the packer release and set the liner hanger/packer position.

After port 252 has effectively been closed off, rupture disc 214 is broken with applied pressure and the axial shifting mandrel 201 is lifted to take collet 248 out of groove 250 until travel stop 276 is engaged as shown in FIG. 9. Several processes take place during this lifting of the axial shifting mandrel 201. First, the lower ports 252 and 254 are misaligned closing off flow to below the packer. At the same time, the upper ports 260 and 266 are misaligned closing off flow above the packer. At the same time the mandrel assembly 301 gets rotationally locked to the rotary sleeve 203 by the engagement of tooth pattern 304 to respective pattern 306 with 306 held by drag blocks 308. Furthermore there is a lower travel stop 300 that limits the downward movement of the mandrel assembly 301 with respect to the axial shifting mandrel 201. It should also be noted that lifting the axial shifting mandrel 201 disengages a mandrel spline 302 at the bottom end of the mandrel assembly 301 to permit the relative rotation of the axial shifting mandrel 201 with respect to the mandrel assembly 301 for ejection of ball 280 through opening 278 described later. Furthermore, picking up the axial shifting mandrel 201, as shown in FIG. 9, also rotationally releases the axial shifting mandrel 201 from the rotary sleeve 203 by disengaging the rotational lock between the torque stinger 205 and lock block 207. With additional pickup, the packer 208 is released, seen in FIG. 9, by breaking a shear ring 310 that defeats the collet thread 229 to physically extend the packer 208 in a known manner. Once the packer 208 is released the setting of the liner hanger and packer can take place. The preferred way to set the liner hanger/packer is by release of dart or ball 286. The same pickup force that engaged lower travel stop 300 undermines support for flappers 288 and 290 by respectively aligning grooves 292 and 294 momentarily as the relative movement occurs. When flappers 288 and 290 have been removed from the darts path it can then be pumped down to set the liner tools below. It should be noted that in the run in position of FIG. 6 there is a bypass around the dart 286 from entrance 296 to exit 298 as shown in FIG. 6*h*. The same pick up that released the flappers 288 and 290 also moves outlet hole 278 up to ball 280 that is still held out of bore 281 by a retainer 282. There is a cam surface 284 which when rotated against ball 280 can push ball 280 through the retainer 282 so it can drop to the liner hanger/packer that is not shown for its operation with applied pressure on the seated ball 280. The setting of the liner hanger/packer that is not shown also allows the release of the tool for pulling out of the hole.

Those skilled in the art will appreciate that the embodiments of the present invention to enable top down cementing. The tool is run down with circulation enabled for location of the liner. The cementing bore is isolated at the top from the displaced fluid bore and running in an object into the cementing bore allows pressuring up to set the cement packer. Further manipulation aligns the cement crossover exit ports to ports leading out of the tool below the set cement packer. At this time the fluid return ports through the tool body from the return bore are already aligned or are being aligned. At the same time a dart is dropped on the ball used to set the packer and cement can be delivered with displaced fluid crossing over from the other bore at a location above the packer that is set to an upper annulus. The cementing crossover ports are then blocked with a second dart so that built up pressure can break a rupture disc and open up the return bore at the top of the cementing bore that is now closed. As the rupture disc breaks a sleeve with a metering device and a seated ball move in tandem. This movement exposes a packer release port leading to a release cylinder. Pressuring on the cylinder actuates the movement that releases a spring housing to extend the packer to retract the seal. The shifting of the cylinder also closes off the crossover port for returns from the displaced fluid bore. With lateral openings from the displaced fluids bore closed, pressuring on the ball in the displaced fluids bore launches this ball through its seat to the liner hanger packer that is not shown so that the liner hanger can be set and the top down cementing tool can be released and pulled out of the hole.

In the alternative embodiment of FIGS. 6-9 the tool is open for circulation during running in. A ball is dropped on a seat and pressured on to sets the packer. Additional pressure is applied to release a flapper that prevents up-hole flow in the cementing bore. A pickup force aligns the cement crossover exit ports from the cementing bore with the displaced fluid crossover exit ports already in alignment. A ball and dart are landed and cement is pumped through the cement bore and out of the tool and displaced fluids cross over above the set cementing packer. A second dart then blocks the cement crossover exit ports and pressuring up on the cement bore then breaks a rupture disc to open the displaced fluid bore for flow in the down-hole direction. A pickup force allows the releases of a dart to set the line hanger packer that is not shown and release the tops down cementing tool in a known manner. As a backup a ball can be cammed out of a hole with relative rotation of adjacent housing components after aligning an exit port for the ball with the picking up. The picking up also closes the crossover exit port to allow pressuring up on the dart to deliver the dart to the liner hanger packer.

In either case, rotation during cementing is enabled. Top down cementing is made possible by setting a cement packer and opening a cement crossover port below the set cement packer so that cement can be delivered in a down-hole direction and returns are blocked from the cement bore and come up and crossover an adjacent bore that has an initially closed upper end and a displaced fluid exit port above the set packer and below the closed upper end for the displaced fluid bore. The displaced fluid bore is then opened after cementing and lateral ports in both bores are isolated and the cement packer is unset while a ball or dart is released through the displaced fluid bore with the cement bore isolated to pressure from above. The liner hanger packer is set and the running tools are released and the top down cementing tool is pulled out of the hole.

The above description is illustrative of the preferred embodiment and many modifications may be made by those skilled in the art without departing from the invention whose scope is to be determined from the literal and equivalent scope of the claims below:

We claim:

1. A top down cementing method for a tubular string to be supported from an existing string at a subterranean location, comprising:

positioning the tubular string relative to said existing string with a top down cementing running tool;

configuring said cementing running tool with an external barrier and at least one bore internally;

setting said external barrier;

delivering a sealing material laterally out of said cementing running tool on a downhole side of said set external barrier to flow down toward a fluid return port;

taking displaced fluid returns from said fluid return port and expelling said fluid laterally out of said cementing running tool on an uphole side of said set external barrier;

releasing said external barrier;

securing said tubular string to said existing string through said bore independently of said external barrier;

removing said cement running tool with said external barrier from said tubular string.

2. The method of claim 1, comprising:

using a sealing material bore for said delivering and a return bore for said taking displaced fluid.

3. The method of claim 2, comprising:

leaving said sealing material bore open for running in;

obstructing said sealing material bore with a first object;

setting said external barrier with pressure on said first object.

4. The method of claim 3, comprising:

opening a sealing material lateral exit port after setting said external barrier with pressure on said first object or a pickup force applied to said cementing running tool.

5. The method of claim 4, comprising:

closing said sealing material exit port after said delivering.

6. The method of claim 5, comprising:

dropping a dart adjacent said first object to close said sealing material exit port after said delivering or closing said sealing material exit port with another pickup force applied to said cementing running tool.

7. The method of claim 4, comprising:

opening a top end of said return bore to said sealing material bore with pressure in said sealing material bore;

retaining said return bore closed despite said opening said top end with a sealing object below said top end.

8. The method of claim 7, comprising:

moving said sealing object in said return bore to open a lateral passage to said external barrier;

releasing said external barrier through said opened lateral passage while maintaining said return bore closed with said sealing object.

9. The method of claim 8, comprising:

closing a displaced fluid lateral port while releasing said external barrier.

10. The method of claim 9, comprising:

moving said sealing object with an associated seat to a travel stop to open lateral passage to said external barrier;

blowing said sealing object through said associated seat;

landing said sealing object in a liner hanger packer;

pressuring on said sealing object in said liner hanger packer for said securing said tubular string to said existing string.

11. The method of claim 9, comprising:

closing said displaced fluid lateral port with movement of said sealing object.

12. The method of claim 4, comprising:

rotating said cementing running tool during said delivering.

13. The method of claim 3, comprising:

opening said lateral sealing material exit port with a pickup force applied to said cementing running tool after setting said external barrier.

14. The method of claim 13, comprising:

closing said sealing material bore to uphole flow at a location downhole from said sealing material exit port.

15. The method of claim 13, comprising:

opening a top end of said return bore to said sealing material bore with pressure in said sealing material bore;

applying another pickup force to said cementing running tool to close a return fluid lateral exit port located above said external barrier.

16. The method of claim 15, comprising:

retracting said external barrier with said applying said another pickup force.

17. The method of claim 16, comprising:

undermining support for a sealing object by applying yet another pickup force;

delivering said sealing object to a liner hanger packer for setting to secure said tubular string to said existing string and release said cementing running tool from said tubular string.

18. The method of claim 17, comprising:

locating said sealing object in a common bore adjacent said sealing material and return bores;

supporting said sealing object on opposed ends in said common bore;

providing a bypass passage around said sealing object when said sealing object blocks said common bore.

19. The method of claim 17, comprising:

aligning, with said yet another pickup force, a setting ball exit port into a common bore adjacent said sealing material and return bores, with a setting ball stored outside said common bore;

enabling relative rotation in said cementing running tool with said applying said yet another pickup force so that a cam surface adjacent said setting ball forces said setting ball into said common bore to travel to a liner hanger packer for a backup way to set said liner hanger packer for supporting said tubular string to said existing string and release of said cementing running tool.

20. The method of claim 16, comprising:

releasing said cementing running tool from said tubular string using mechanical manipulation of said cementing running tool.

21. The method of claim 16, comprising:

closing said bypass passage for releasing said sealing object.

22. The method of claim 2, comprising:

launching an object from said return bore for said securing said tubular string to said existing string and releasing of said cementing running tool from said tubular string.

23. The method of claim 1, comprising:

launching an object through said bore for said securing said tubular string.

24. The method of claim 1, comprising:

rotating said cementing running tool during said delivering.

25. The method of claim 1, comprising:

performing said setting the external barrier through releasing said cementing running tool without manipulation of a running string supporting said cementing running tool.

26. The method of claim 1, comprising:

using applied pressure only for performing said setting the external barrier through releasing said cementing running tool.

27. A top down cementing method for a tubular string to be supported from an existing string at a subterranean location, comprising:

positioning the tubular string relative to said existing string with a top down cementing running tool;

configuring said cementing running tool with an external barrier and at least one bore internally;

setting said cementing external barrier;

delivering a sealing material laterally out of said cementing running tool on a downhole side of said set external barrier;

taking displaced fluid returns laterally out of said cementing running tool on an uphole side of said set external barrier;

releasing said external barrier;

securing said tubular string to said existing string through said bore;

releasing said cementing running tool from said tubular string;

using a sealing material bore for said delivering and a return bore for said taking displaced fluid;

breaking a rupture disc to provide access from said sealing material bore to the top end of said return bore;

retaining a movable barrier in said return bore below said rupture disc;

moving said barrier while still isolating said return bore so that applied pressure in said return bore upper end releases said external barrier.

28. The method of claim 27, comprising:

regulating said movable barrier movement rate to retain the sealing integrity of said movable barrier;

opening pressure access to said external barrier with said movement of said movable barrier;

unlocking a potential energy force to extend said external barrier for release by applying pressure to said external barrier packer through said opening pressure access.

29. The method of claim 28, comprising:

using a ball that is later blown through a respective seat as said movable barrier;

delivering said ball to a liner hanger packer to secure said tubular string to said existing string and to release said cementing running tool.

30. The method of claim 28, comprising:

closing a return fluid lateral port in said return bore with said potential energy force;

opening a sealing material lateral port in said sealing material bore after setting said external barrier with pressure on a barrier added to said sealing material bore;

closing said sealing material lateral port after said delivering;

breaking said rupture disc in said return bore after closing said sealing material lateral port.

31. A top down cementing method for a tubular string to be supported from an existing string at a subterranean location, comprising:

positioning the tubular string relative to said existing string with a top down cementing running tool;

configuring said cementing running tool with an external barrier and at least one bore internally;

setting said external barrier;

delivering a sealing material laterally out of said cementing running tool on a downhole side of said set external barrier;

taking displaced fluid returns laterally out of said cementing running tool on an uphole side of said set external barrier;

releasing said external barrier;

securing said tubular string to said existing string through said bore;

releasing said cementing running tool from said tubular string;

using a sealing material bore for said delivering and a return bore for said taking displaced fluid;

launching an object from said return bore for said securing said tubular string to said existing string and releasing of said cementing running tool from said tubular string;

initially locating said object between a return fluid lateral exit port in said return bore and a rupture disc at an upper end of said return bore.

* * * * *